US012569062B1

(12) United States Patent
Allen

(10) Patent No.: US 12,569,062 B1
(45) Date of Patent: Mar. 10, 2026

(54) LOCKER WITH RECLINING SEAT AND ROLL-UP DOOR

(71) Applicant: AIM Design, LLC, Desoto, TX (US)

(72) Inventor: Sam Allen, Maypearl, TX (US)

(73) Assignee: AIM Design, LLC, Desoto, TX (US)

( * ) Notice: Subject to any disclaimer, the term of this patent is extended or adjusted under 35 U.S.C. 154(b) by 156 days.

(21) Appl. No.: 18/516,556

(22) Filed: Nov. 21, 2023

Related U.S. Application Data

(63) Continuation-in-part of application No. 17/861,684, filed on Jul. 11, 2022, which is a continuation-in-part of application No. 16/515,605, filed on Jul. 18, 2019, now Pat. No. 11,382,423.

(60) Provisional application No. 62/732,833, filed on Sep. 18, 2018.

(51) Int. Cl.
*A47B 83/00* (2006.01)
*A47B 61/00* (2006.01)
*A47C 1/034* (2006.01)

(52) U.S. Cl.
CPC ..... *A47B 83/00* (2013.01); *A47B 61/00* (2013.01); *A47C 1/0347* (2013.01)

(58) Field of Classification Search
CPC ..... A47B 61/00; A47B 83/00; A47C 1/0347
USPC ..... 312/235.2, 235.5, 235.9
See application file for complete search history.

(56) References Cited

U.S. PATENT DOCUMENTS 429,421 A 6/1890 Coit
1,281,923 A 10/1918 Fales
1,491,039 A 4/1924 Voina-Hansen
1,830,804 A 11/1931 Piquette
2,457,445 A 12/1948 Clair
2,923,584 A 2/1960 Broderick
3,222,105 A 12/1965 Cross
3,317,259 A 5/1967 Otis
3,353,865 A 11/1967 Bass
3,712,697 A 1/1973 Kelley
4,165,124 A 8/1979 Olan
4,456,316 A 6/1984 Lundgren
4,460,094 A 7/1984 Schoen
4,460,145 A * 7/1984 Ando ..... A47B 23/02 108/5
4,512,241 A 4/1985 Morris
4,699,267 A 10/1987 Burke
4,957,302 A * 9/1990 Maxwell ..... A47C 3/0257 280/32.6
5,121,974 A 6/1992 Monson
5,468,063 A 11/1995 Simonek
5,547,270 A 8/1996 Dang
5,791,749 A 8/1998 O'Neill
5,992,648 A 11/1999 Saunders
6,336,691 B1 1/2002 Maroney
(Continued)

OTHER PUBLICATIONS

Office Action dated May 29, 2020 from U.S. Appl. No. 16/515,605.
(Continued)

*Primary Examiner* — James O Hansen
(74) *Attorney, Agent, or Firm* — James E. Walton

(57) ABSTRACT

A locker has a reclining seat and an interior storage area. The reclining seat has a headrest, a seatback, a bench, a leg rest, and a footrest. The locker further having an electronic device holder at the top of the interior storage area. The reclining seat being fastened to a seat support assembly. The seat support assembly comprising a frame assembly, at least one curved base; and a seat support base.

11 Claims, 31 Drawing Sheets

(56) References Cited

U.S. PATENT DOCUMENTS

| | | | | |
|---|---|---|---|---|
| 6,491,342 | B1 * | 12/2002 | Smith | A47C 1/0352 297/68 |
| 6,508,525 | B2 | 1/2003 | Picogna | |
| 6,513,889 | B1 | 2/2003 | Park | |
| 6,598,948 | B1 | 7/2003 | Harmon | |
| 7,963,621 | B1 | 6/2011 | Ellis | |
| 8,403,415 | B2 * | 3/2013 | Lawson | B64D 11/064 297/354.13 |
| 8,714,669 | B1 | 5/2014 | Clausen | |
| 8,733,865 | B1 | 5/2014 | Chambers | |
| 9,351,890 | B2 * | 5/2016 | Hough | A61G 5/1005 |
| 2001/0020810 | A1 * | 9/2001 | Kennedy | A47B 21/00 312/249.7 |
| 2007/0132292 | A1 | 6/2007 | Robertson | |
| 2007/0278914 | A1 | 12/2007 | Verfaillie | |
| 2009/0019634 | A1 | 1/2009 | Lipponen | |
| 2010/0201230 | A1 | 8/2010 | Schweitzer, III | |
| 2014/0319984 | A1 | 10/2014 | Younts | |
| 2016/0206099 | A1 * | 7/2016 | Robertson | A47C 1/03294 |
| 2016/0258108 | A1 * | 9/2016 | Jindra | A47B 81/00 |

OTHER PUBLICATIONS

Amendment dated Jul. 23, 2020 from U.S. Appl. No. 16/515,605.
Final Office Action dated Oct. 21, 2020 from U.S. Appl. No. 16/515,605.
Amendment After Final dated Dec. 17, 2020 from U.S. Appl. No. 16/515,605.
Advisory Action dated Dec. 28, 2020 from U.S. Appl. No. 16/515,605.
Amendment dated Jan. 21, 2021 from U.S. Appl. No. 16/515,605.
Office Action dated Apr. 13, 2021 from U.S. Appl. No. 16/515,605.
Amendment dated May 25, 2021 from U.S. Appl. No. 16/515,605.
Final Office Action dated Jun. 24, 2021 from U.S. Appl. No. 16/515,605.
Amendment After Final dated Jul. 19, 2021 from U.S. Appl. No. 16/515,605.
Advisory Action dated Jul. 28, 2021 from U.S. Appl. No. 16/515,605.
Amendment dated Sep. 23, 2021 from U.S. Appl. No. 16/515,605.
Office Action dated Oct. 20, 2021 from U.S. Appl. No. 16/515,605.
Amendment dated Dec. 30, 2021 from U.S. Appl. No. 16/515,605.
Final Office Action dated Feb. 22, 2022 from U.S. Appl. No. 16/515,605.
Amendment After Final dated Mar. 9, 2022 from U.S. Appl. No. 16/515,605.
Advisory Action dated Mar. 16, 2022 from U.S. Appl. No. 16/515,605.
Amendment dated May 13, 2022 from U.S. Appl. No. 16/515,605.
Notice of Allowance dated May 27, 2022 from U.S. Appl. No. 16/515,605.

* cited by examiner

LOCKER WITH RECLINING SEAT AND ROLL-UP DOOR

CROSS-REFERENCE TO RELATED APPLICATIONS

This application is a continuation-in-part of U.S. patent application Ser. No. 17/861,684, filed 11 Jul. 2022, titled "Locker with Reclining Seat and Roll-Up Door," which is a continuation-in-part of U.S. application Ser. No. 16/515,605, filed 18 Jul. 2019, titled "Locker with Reclining Seat and Roll-Up Door," which issued as a U.S. Pat. No. 11,382,423 on 12 Jul. 2022, which claims the benefit of U.S. Provisional Application No. 62/732,833 filed 18 Sep. 2018, titled "Locker with Reclining Seat and Roll-Up Door," all of which are hereby incorporated by reference in their entirety for all purposes.

BACKGROUND

1. Field of the Invention

The present invention relates generally to improvements in lockers or storage cabinets used in athletic or sporting facilities, and more specifically to seating integrated into such lockers.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
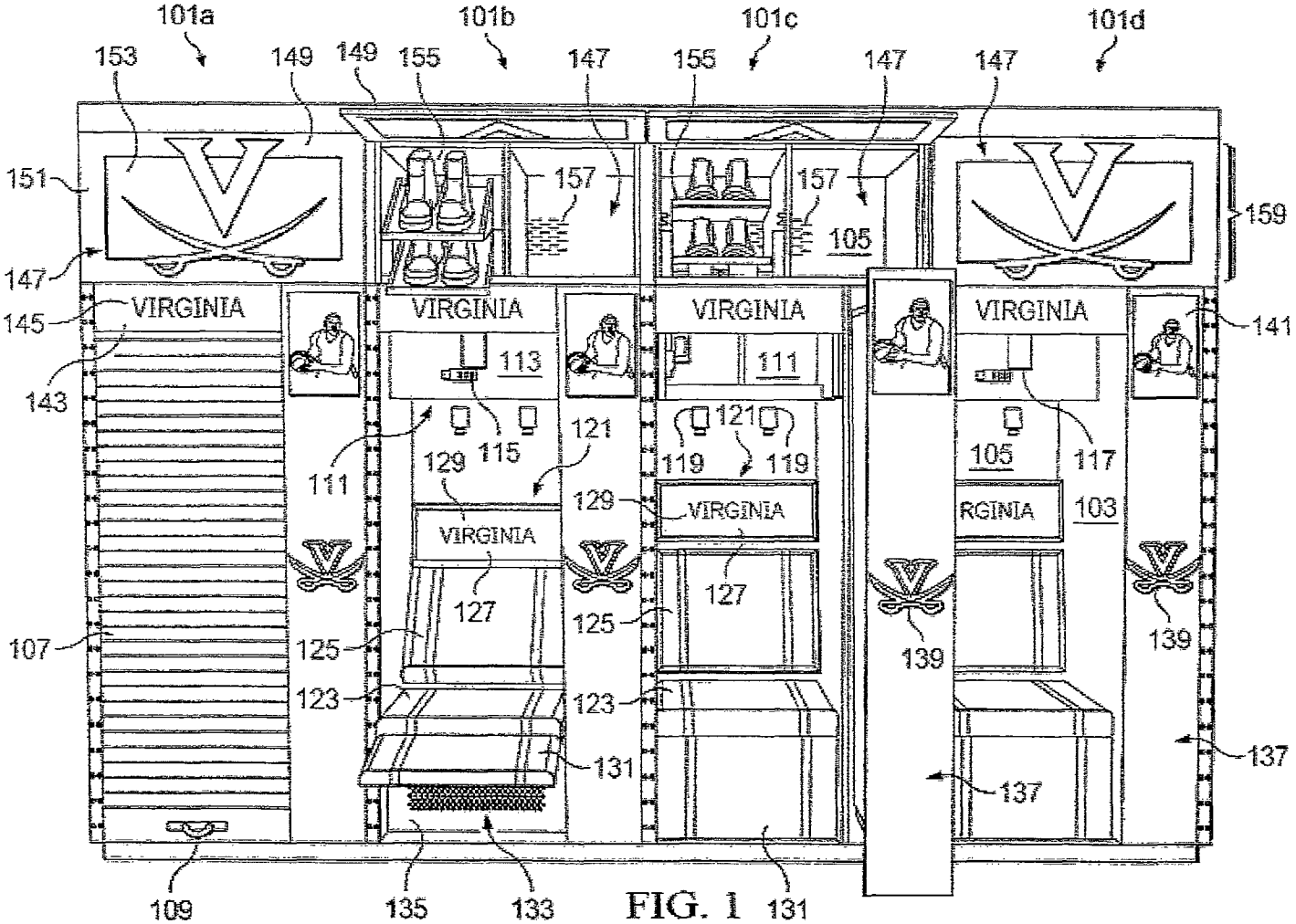
FIGS. 1 and 2 are perspective views of multiple examples of a locker according to a preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. It is also appreciated that the use of "a" or "an" before a noun naming an object is construed to be that the noun refers to both the singular and the plural.

Figure 2:
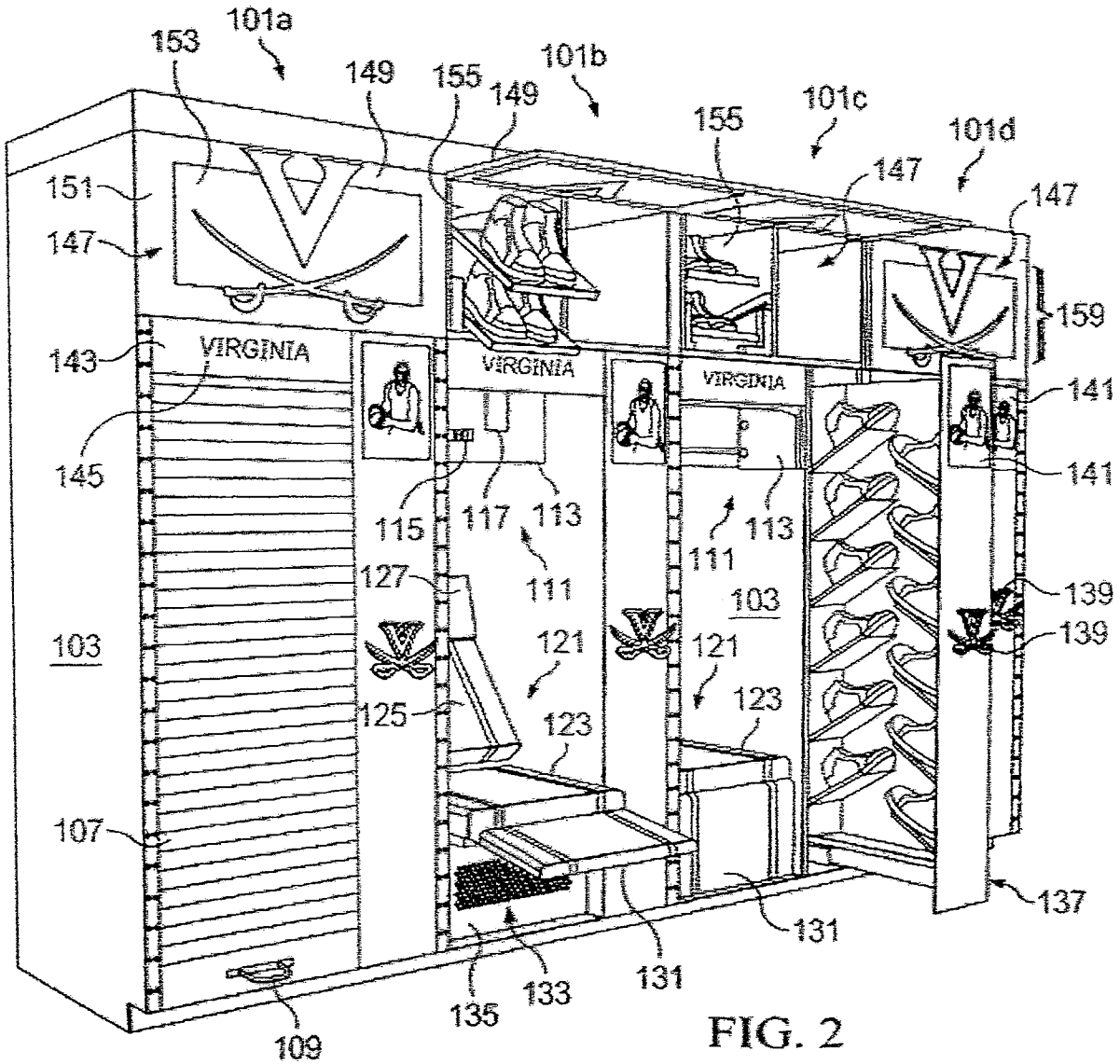

Referring now to FIGS. 1 and 2 in the drawings, lockers 101*a*, 101*b*, 101*c*, and 101*d* according to the preferred embodiment of the present application are depicted. Locker 101*a* shows locker 101*a* wherein a roll-up door 107 and an overhead door 149 are in closed positions, and a shoe storage unit or compartment 137 is in a retracted position. Locker 101*b* shows locker 101*b* wherein roll-up door 107 is in an open position, a compartment door 113 is in a closed position, a seat 121 is in a reclined position, overhead door 149 is in an open position, and a shoe shelf 155 is extended from an overhead compartment 145. Locker 101*c* shows locker 101*c* wherein roll-up door 107 is in an open position, compartment door 113 is in an open position, seat 121 is in an upright position, overhead door 149 is in an open position, and shoe shelf 155 is retracted into overhead compartment 145. Locker 101*d* shows a locker 101*d* wherein doors 147 and 113 are in closed positions, seat 121 is in an upright position, shoe storage compartment 137 is in a retracted position, and roll-up door 107 is in an open position.

Referring now also to FIGS. 3A-3C and 4 in the drawings, lockers 301*a*-301*c*, 401*a*-401*c* according to the preferred embodiment of the present application are depicted. Locker 301*a* is the same as lockers 101*a*-101*d* but further showing a preferred embodiment of door chamber 307, door-guiding component 305, and plenum 303, which are excluded from FIGS. 1 and 2 for clarity. Locker 301*a* also shows the preferred stored configuration of door 107 when the door is in an open position. Lockers 301*b*-301*c* are alternative embodiments of locker 301*a* that show two different configurations of roll-up door 107, door chamber 307, and door-guiding component 305. Lockers 401*a*-401*c* are the same as lockers 101*a*-101*d*, 301*a*, but further showing control panel 403, which is excluded from FIGS. 1, 2, and 3A-3C for clarity. Lockers 401*a*-401*c* also do not show door-guiding component 305 and door 107 for clarity.

Figure 5A:
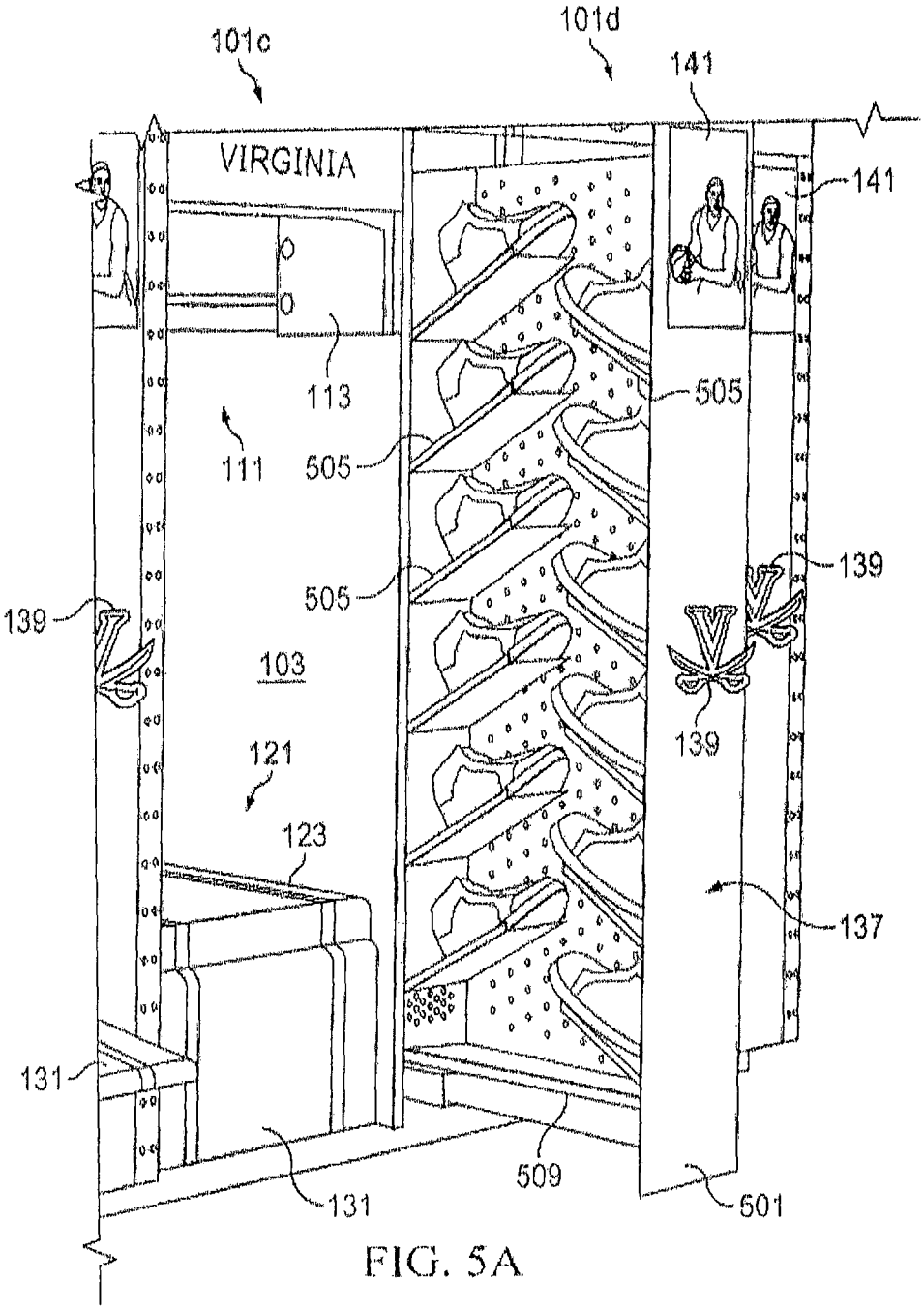
FIGS. 5A and 5B are enlarged views of a pull-out shoe drawer feature of the lockers of FIGS. 1 and 2.
Figure 5B:
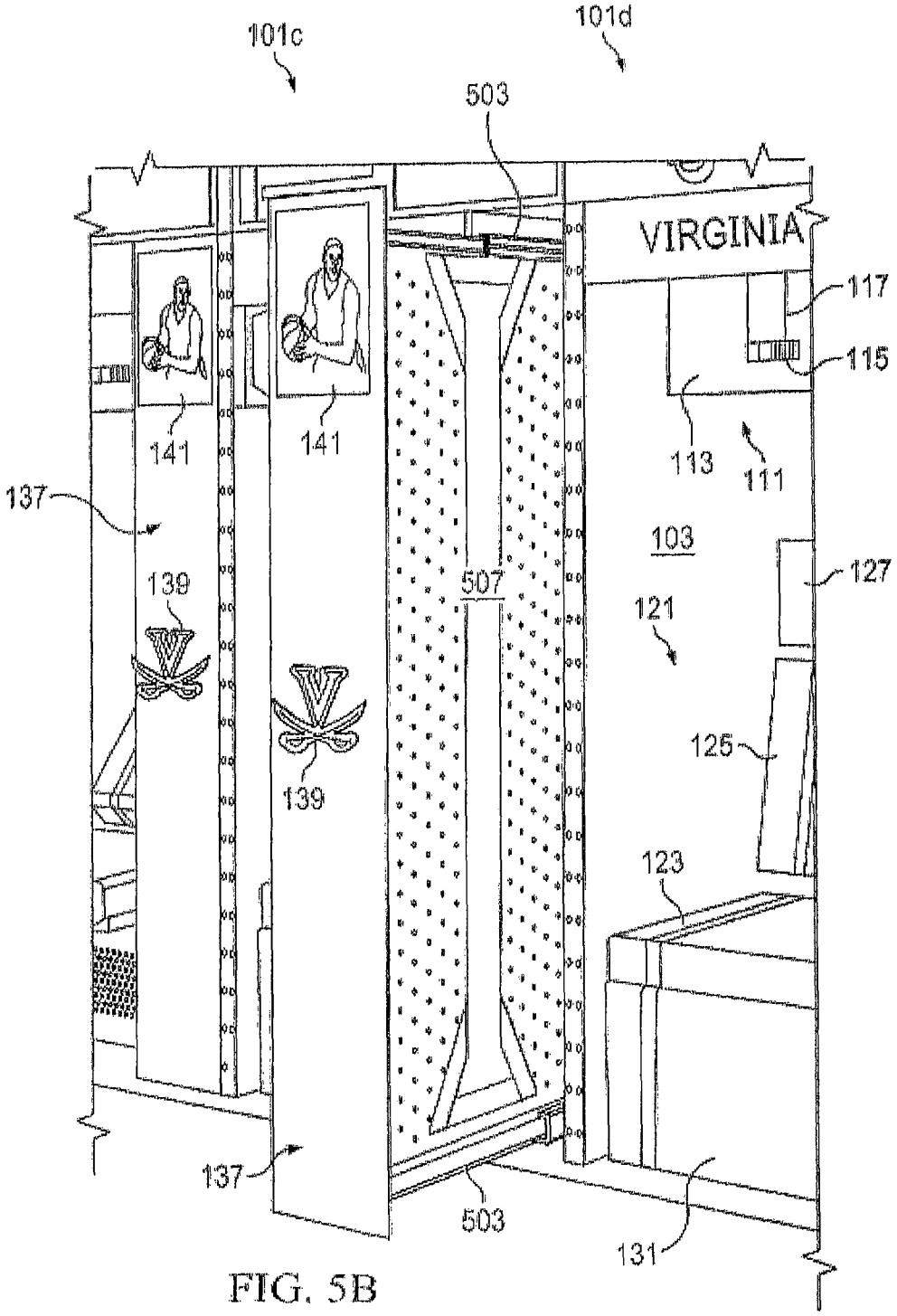

Referring now also to FIGS. 5A and 5B in the drawings, lockers 101*c* and 101*d* from FIGS. 1 and 2 are shown in an enlarged view to better show shoe storage unit or compartment 137. FIG. 5A shows shoe storage compartment 137, as well as projections 505, end walls 501, and removable tray 509. FIG. 5B shows shoe storage compartment 137, as well as rear wall 507 and drawer slides 503. In the preferred embodiment, shoe storage unit 137 includes self-closing soft-close drawer slides that assist with closing shoe storage unit 137 and prevent shoe storage unit 137 from slamming closed, thereby reducing the chance that locker 101*c* and 101*d* are damaged from rough and/or abusive use.

Lockers 101*a*-101*d*, 301*a*-301*c*, 401*a*-401*c* generally comprise a pair of upstanding sidewalls 103 that generally define the extent of the lockers 101*a*-101*d*, 301*a*-301*c*, 401*a*-401*c*. A back wall 105 connects sidewalls 103 at the rear of each locker 101, 301, 401 (see FIGS. 1, 3A-C, and 4). Sidewalls 103 and back walls 105 may be made various materials, including wood, laminates, polymers, metals, and composites. The material choice will depend upon the properties desired for the chosen application and embodiment of lockers 101*a*-101*d*, 301*a*-301*c*, 401*a*-401*c*. For example, lockers 101*a*-101*d*, 301*a*-301*c*, 401*a*-401*c* that will be holding dirty and wet equipment may be better suited for construction from polymer since polymer is durable and easy to clean, whereas lockers 101*a*-101*d*, 301*a*-301*c*, 401*a*-401*c* at a prestigious or upscale institution might be made from wood or laminate since wood and laminate create a nicer appearance. Each locker 101*a*-101*d*, 301*a*-301*c*, 401*a*-401*c* may be installed adjacent to another, similar or identical lockers 101*a*-101*d*, 301*a*-301*c*, 401*a*-401*c*, with lockers 101*a*-101*d*, 301*a*-301*c*, and 401*a*-401*c* rear against a wall, and lockers 101*a*-101*d*, 301*a*-301*c*, and 401*a*-401*c* front facing the interior of a locker room. Each locker 101*a*-101*d*, 301*a*-301*c*, 401*a*-401*c* may also be installed behind and facing the opposite direction of another, similar or identical lockers 101*a*-101*d*, 301*a*-301*c*, 401*a*-401*c*, with lockers 101*a*-101*d*, 301*a*-301*c*, and 401*a*-401*c* rear walls against the rear wall of another lockers 101*a*-101*d*, 301*a*-301*c*, 401*a*-401*c* and lockers 101*a*-101*d*, 301*a*-301*c*, and 401*a*-401*c* front facing the interior of a locker room. Sidewalls 103 and back walls 105 may be arranged to create an interior area of lockers 101*a*-101*d*, 301*a*-301*c*, 401*a*-401*c*.

Between the sidewalls 103 of lockers 101*a*-101*d*, 301*a*-301*c*, 401*a*-401*c*, a plurality of compartments 111 are defined by shelves or other horizontally extending surfaces or platforms (see FIGS. 1-5B). As used herein, "sidewall" or "sidewalls" may refer to either "main" sidewalls 103 or other upstanding or generally vertical sidewalls arranged between the "main" sidewalls. Multiple additional sidewalls 103 may be placed between the "main" or exterior sidewalls 103 to define compartments 111 in cooperation with generally horizontally extending shelves or platforms. The sidewalls and shelves of compartments 111 may be made of the same materials of sidewalls 103 and back walls 105 of lockers 101*a*-101*d*, 301*a*-301*c*, 401*a*-401*c*, or may be made of differing materials, depending on the desired properties of the specific application and embodiment of lockers 101*a*-101*d*, 301*a*-301*c*, 401*a*-401*c*. Each compartment 111 may be sized and otherwise configured for storage of clothing or sporting equipment or other items and may include at least one door 113, which may be lockable with lock 115. Compartments 111 may further contain features such as electrical outlets or charging ports.

A plenum 303 may be mounted on the rear or exterior side of back wall 105 (see FIGS. 3A-3C and 4, not shown in FIGS. 1-2). Plenum 303 may be connected via duct work to the existing HVAC of the locker room or room in which lockers 101*a*-101*d*, 301*a*-301*c*, 401*a*-401*c* are disposed or situated. The HVAC system to which plenum 303 is connected may be the conventional heating and cooling system of the building or room in which lockers 101*a*-101*d*, 301*a*-301*c*, 401*a*-401*c* are disposed, or may be a dedicated system for lockers 101*a*-101*d*, 301*a*-301*c*, 401*a*-401*c* themselves. The HVAC system thus provides heated, cooled, and/or dehumidified air to each locker 101*a*-101*d*, 301*a*-301*c*, 401*a*-401*c* through plenum 303.

Plenum 303 may communicate air from the HVAC system to the interior and various compartments 111, 133, 137, 147 of lockers 101*a*-101*d*, 301*a*-301*c*, 401*a*-401*c* through a plurality of ventilation apertures or grilles 157 formed in back wall 105. Preferably, a grille or aperture 157 (grille is used herein to mean a single aperture or a group of apertures in any arrangement, e.g. circles, squares, other shapes, arranged in any pattern) is arranged through back wall 105 at least at an upper extent of lockers 101*a*-101*d*, 301*a*-301*c*, 401*a*-401*c* to insure a supply of air to the entirety of locker 101*a*-101*d*, 301*a*-301*c*, 401*a*-401*c* or at least the upper compartments thereof. As illustrated, a ventilation aperture or grille 157 is located in an overhead compartment 147.

Grilles 157 may preferably be provided with a damper arrangement or mechanism that permits the partial closure or obstruction of the aperture(s) of grilles 157 to control the flow of air from plenum 303. One or more front or forward ventilation grilles may be provided in the front panels or surfaces (forward of back wall 105 and generally between side walls 103) of lockers 101*a*-101*d*, 301*a*-301*c*, 401*a*-401*c* to permit exhaust or intake of air from or to lockers 101*a*-101*d*, 301*a*-301*c*, 401*a*-401*c*. Alternatively, the natural gaps left between doors and openings in lockers 101*a*-101*d*, 301*a*-301*c*, 401*a*-401*c* can provide the exhaust or intake of air. Grilles 157 and their dampers may be controlled (opened or closed, fully or partially) manually or automatically, as by a programmed computer. Automatically controlled grilles may operate on a "schedule" (e.g. open or closed at night or during daylight hours) or according to airflow or other parameters, such as relative humidity in the locker room and the like.

Thus, airflow may be established through lockers 101*a*-101*d*, 301*a*-301*c*, 401*a*-401*c* from plenum 303, through ventilation grille 157, and out of lockers 101*a*-101*d*, 301*a*-301*c*, 401*a*-401*c* through other grilles or other openings in the front or forward portions of lockers 101*a*-101*d*, 301*a*-301*c*, 401*a*-401*c*. Alternatively, air circulated through lockers 101*a*-101*d*, 301*a*-301*c*, 401*a*-401*c* may be exhausted through a duct or conduit to an area remote from lockers 101*a*-101*d*, 301*a*-301*c*, 401*a*-401*c* and/or the locker room or building in which lockers 101*a*-101*d*, 301*a*-301*c*, 401*a*-401*c* are located. Ventilation may be assisted by one or more circulation fans located in lockers 101*a*-101*d*, 301*a*-301*c*, 401*a*-401*c* (not shown). Some embodiments of lockers 101*a*-101*d*, 301*a*-301*c*, 401*a*-401*c* may contain equipment drying fixtures such as glove dryers or shoe dryers. Some embodiments of lockers 101*a*-101*d*, 301*a*-301*c*, 401*a*-401*c* may include components to enable ventilation in a seat assembly.

The interior area of the lockers 101*a*-101*d*, 301*a*-301*c*, 401*a*-401*c* may be closed and secured by a roll-up door 107 that slides between sidewalls 103. Roll-up door 107, in a preferred embodiment, is a roll-type door comprising a single panel made of segments of aluminum, but may be made with varying designs and materials depending on the desired properties and application of the lockers 101*a*-101*d*, 301*a*-301*c*, 401*a*-401*c* and door 107. For example, in the embodiment seen in FIG. 3C, door 107 is made of two distinct segmented aluminum panels that retract into and behind locker 301*c* in opposite directions.

Figure 3A:
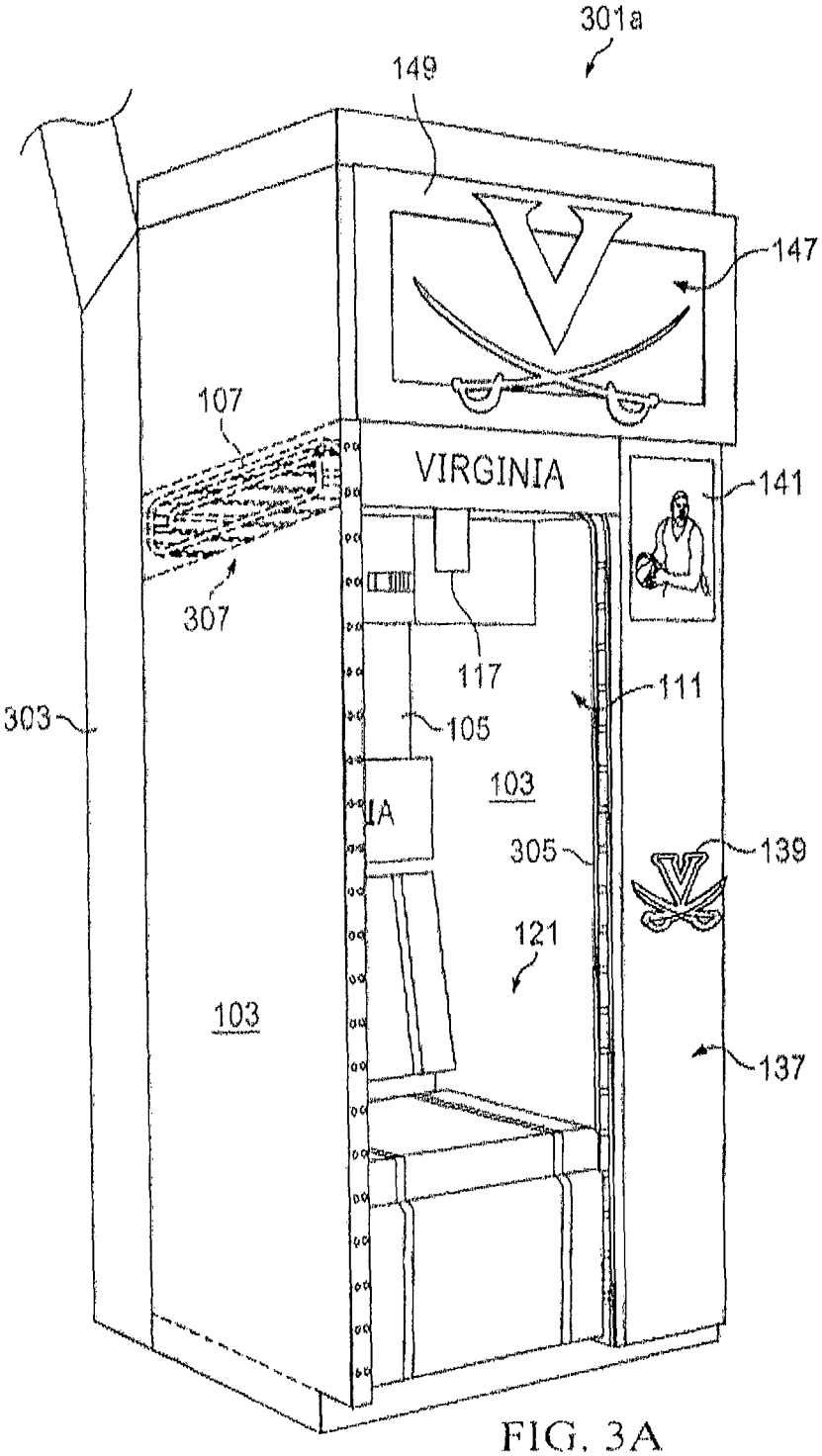
FIGS. 3A-3C are perspective views of the lockers of FIGS. 1 and 2 with the doors shown in an open position, and the seats shown in an upright position.
Figure 3B:
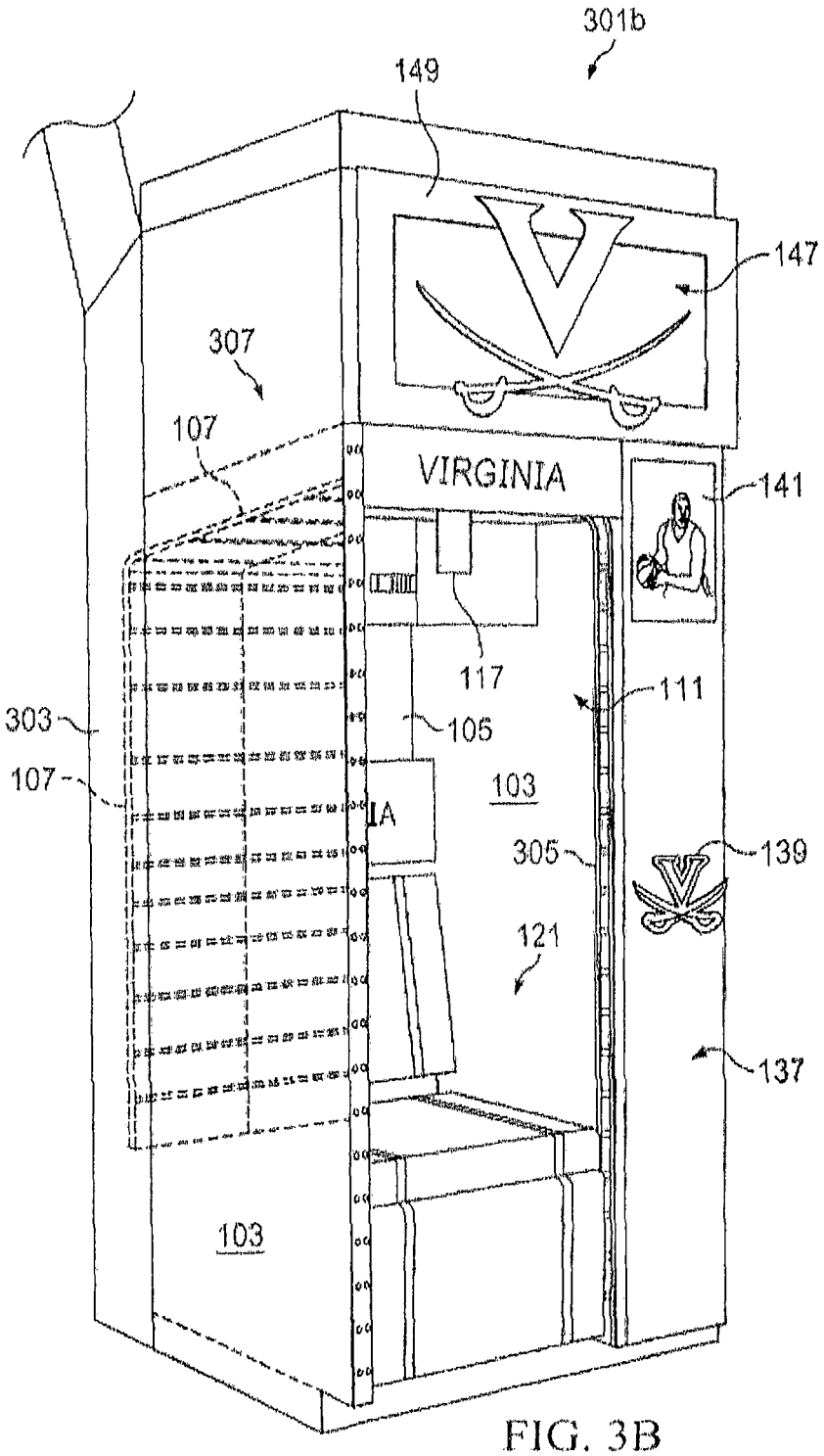
Figure 3C:
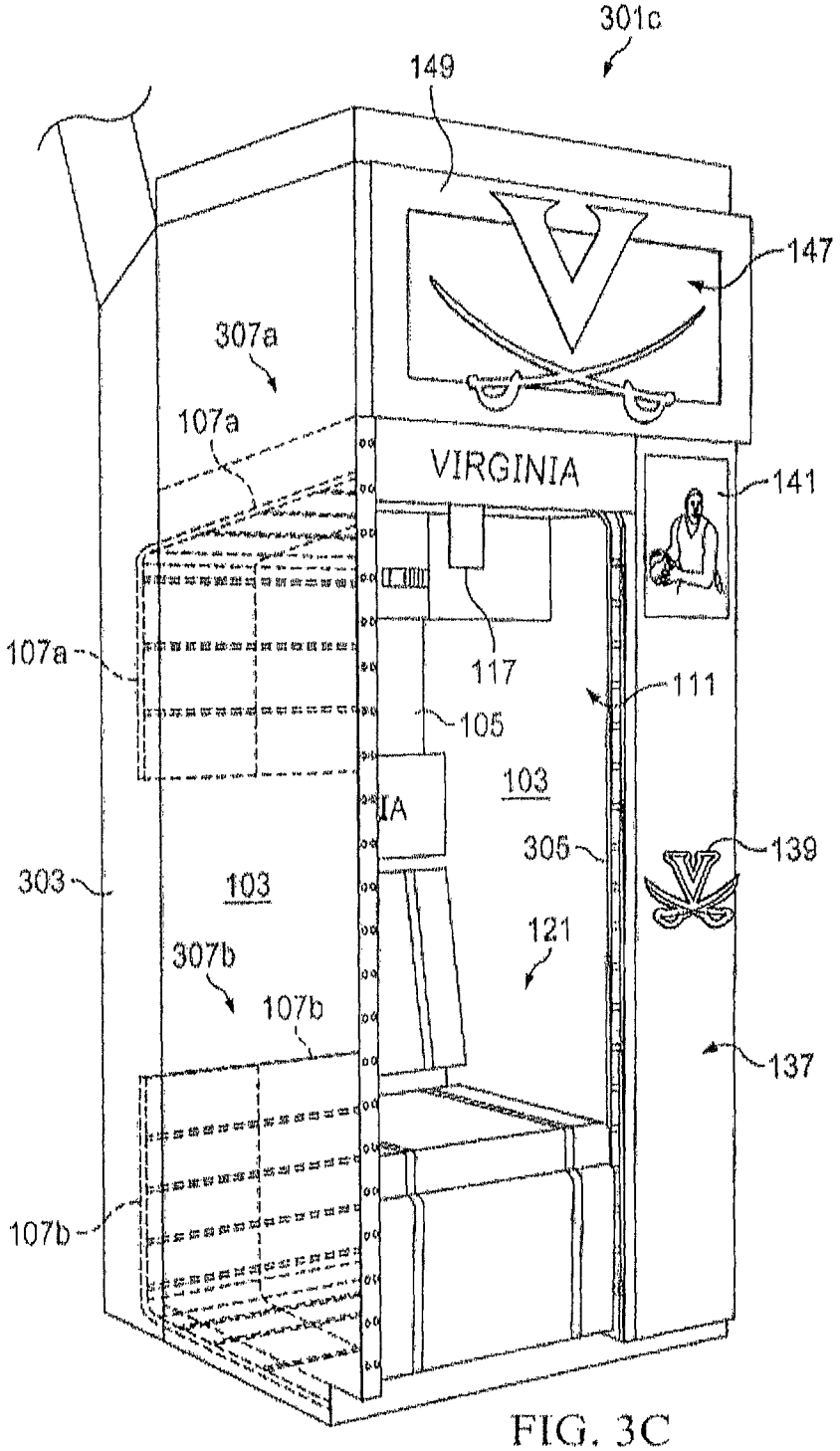
Figure 4:
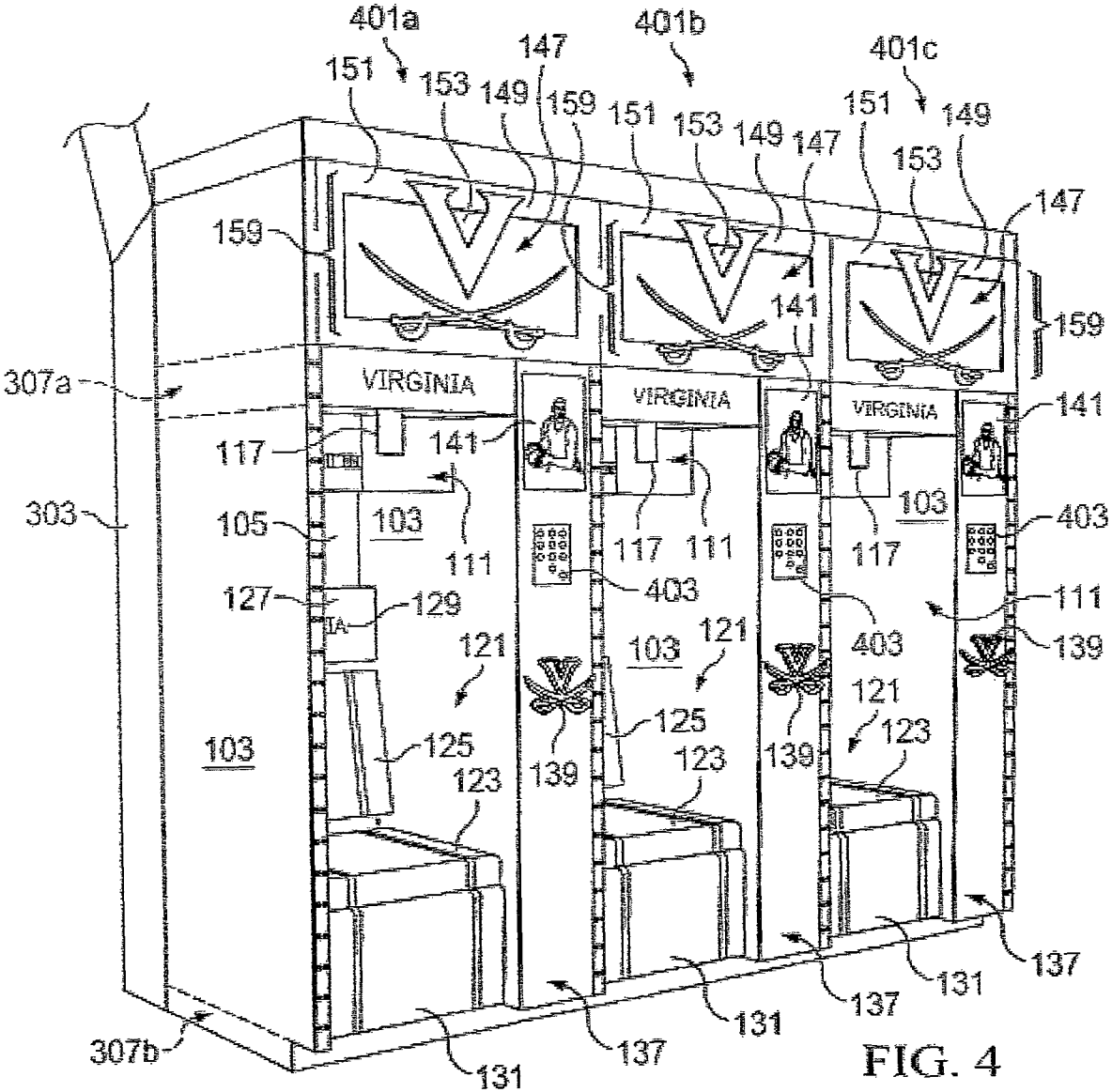
FIG. 4 is a perspective view of three lockers of FIGS. 1-3 connected in series with a control panel.

The placement and the direction of roll-up door 107 is defined by door guiding components 305 (see FIGS. 3A-3C). The door guiding components 305 preferably comprise systems commonly used to guide roll-up or sliding type doors, such as the track or slide systems typically found on garage or loading bay doors. Other embodiments of lockers 101*a*-101*d*, 301*a*-301*c*, 401*a*-401*c* may utilize guiding components 305 comprising various other parts or systems, depending on the design of lockers 101*a*-101*d*, 301*a*-301*c*, 401*a*-401*c*. As illustrated, components 305 are shown as only being present on the right sidewall of the interior area of lockers 101*a*-101*d*, 301*a*-301*c*, 401*a*-401*c*, but in the preferred embodiment components 305 are present on both sides of the interior area so that door 107 is supported along both sides.

When roll-up door 107 is opened, the door retracts into a door chamber 307. In the preferred embodiment, chamber 307 is a contained opening (see FIG. 3A) wherein door 107 winds into a coiled arrangement. The preferred embodiment as depicted in FIG. 3A shows door 107 wound into a generally oval-shaped coil arrangement, but door 107 may be stored in multiple arrangements, such as various wound coil arrangements, arrangements wherein door 107 is layered but not coiled, or arrangements where door 107 is stored in a single layer.

In other embodiments, chamber 307 is a chamber which is open through back wall 105 into a plenum 303 (see FIGS. 3B-3C), and may be a single chamber or split into multiple chambers depending on whether door 107 moves as a single panel or splits into multiple panels upon opening. In the embodiments seen in FIGS. 3*b* and 3C, door 107 passes into and through chambers 307 into plenum 303, and is stored as a single layer behind back wall 105. In other preferred embodiments with chambers 307 open to a plenum 303, door 107 may be wound into coiled or layered arrangements as described with regard to FIG. 3A.

Door 107 may operate in a variety of ways. Door 107 may operate manually such that a user supplies all the force and movement used to open the door. This preferably may be accomplished using a handle 109, or in other embodiments, may be accomplished with the use of a pull chain, strap, or other component which is linked mechanically to a door drive system housed within lockers 101*a*-101*d*, 301*a*-301*c*, 401*a*-401*c*.

Handle 109 is preferably a fabric strap or a rigid handle movably attached to door 107. Door 107 may have a slot or recess which houses handle 109 such that the handle is retracted into the recess in order that handle 109 does not catch on or otherwise contact components of lockers 101*a*-101*d*, 301*a*-301*c*, 401*a*-401*c* during the opening and closing of door 107. In other embodiments, handle 109 may be an opening, recess, or other formed feature in door 107 such that no additional strap or handle components are necessary. Alternatively, door 107 may not have any handle 109 and may instead open with the use of a chains, cables, gears, or other mechanical drive systems.

Door 107 may require manual opening as previously described, but may further contain an assisted-opening action such as a spring drive, hydraulic drive, or counterweight. In an assisted-opening design, such as designs wherein springs, hydraulics, or counterweights supply opening force to door 107, the system may be perfectly balanced such that no additional components are necessary to keep door 107 in an open or closed position. Alternatively, an assisted-opening system may not be perfectly balanced and may require some form of latching, clamping, braking, or other securing component to keep door 107 in an open or closed position.

Door 107 may be a self-opening design which uses some form of door-driving components, such as electrical, hydraulic, or pneumatic motors, connected to door 107 either directly or in combination with an arrangement of mechanical components such as straps, chains, gears, and fasteners.

Roll-up door 107 may be locked and unlocked, opened and closed, or otherwise controlled with control panel 403. (See FIG. 4). As depicted in the preferred embodiment of the present application, control panel 403 is an electronic keypad which, in combination with an electronic locking mechanism, locks roll-up door 107. Panel 403 may simply unlock door 107, or may actually control the opening of door 107 if the door is operated automatically. Control panel 403 is depicted as being mounted on the front of lockers 101*a*-101*d*, 301*a*-301*c*, 401*a*-401*c* on shoe storage compartment 137, but may be mounted at any exterior or interior point of lockers 101*a*-101*d*, 301*a*-301*c*, 401*a*-401*c*, depending on the desired design and configuration of lockers 101*a*-101*d*, 301*a*-301*c*, 401*a*-401*c*. In some embodiments, control panel 403 may be an interactive touch screen that controls more advanced features of lockers 101*a*-101*d*, 301*a*-301*c*, 401*a*-401*c*, such as lighting, ventilation, or any electronic displays, in addition to the unlocking and opening of door 107.

In other embodiments, roll-up door 107 may not make use of control panel 403 at all. Door 107 may simply make use of a simple mechanical lock (not pictured) and be opened manually, or may open automatically and be unlocked and opened remotely with some combination of locker transceiver and remote transceiver. For example, door 107 could be opened remotely by a short range transmitter, such as a common radio wave garage door opener, or such as a Bluetooth-enabled device. Door 107 could also be connected to the internet and controlled wirelessly through the use of software on any internet-capable device, such as a smartphone. In an alternative embodiment, a series of lockers 101*a*-101*d*, 301*a*-301*c*, 401*a*-401*c* may not contain control panels 403, and doors 107 may all be remotely controlled from one common control panel which controls all the connected lockers 101*a*-101*d*, 301*a*-301*c*, 401*a*-401*c* together or individually.

The interior area of the lockers 101*a*-101*d*, 301*a*-301*c*, 401*a*-401*c* contains several features, including preferably and most notably a reclining seat 121 (see FIGS. 1-4). Each seat 121 generally comprises a bench 123, a seatback 125, a footrest 131, and a headrest 127 according to the preferred embodiment in the present application. Bench 123, seatback 125, footrest 131, and headrest 127 may be disposed and extended between sidewalls 103 or other sidewalls defined between sidewalls 103.

Seat 121 is operably moveable between an upright position and a reclined position. When seat 121 is in an upright position, bench 123 is in a generally horizontal position or orientation, and footrest 131, seatback 125, and headrest 127 are in a generally vertical position or orientation. Referring to FIGS. 1 and 2, locker 101*c* depicts seat 121 is in an upright position. When seat 121 is in a reclined position, bench 123 and footrest 131 are in a generally horizontal position, headrest 127 may be in a generally upright or generally reclined position depending on the design of lockers 101*a*-101*d*, 301*a*-301*c*, 401*a*-401*c*, and seatback 125 is in a generally reclined position and may be oriented at any degree between horizontal and vertical depending on the design of lockers 101*a*-101*d*, 301*a*-301*c*, 401*a*-401*c*. Referring to FIGS. 1 and 2, locker 101*b* has seat 121 is in a reclined position.

Seat 121 components bench 123, seatback 125, footrest 131, and headrest 127 are preferably padded and upholstered with an appropriate material, such as vinyl or leather or other textile material. The material and design choices for seat 121 will depend on the desired application and embodiment of lockers 101*a*-101*d*, 301*a*-301*c*, 401*a*-401*c*. Graphics may be present on components of seat 121. For example, referring to FIGS. 1-2, logo 129 is preferably present on headrest 127. As depicted, the logo is a school name, but in other embodiments may be a symbol, institution name, image, other graphic, or any combination thereof. Logo 129 may be an embroidered logo, a printed logo, an embedded feature, or a separate piece which is removably or permanently attached to headrest 127. Logo 129 may also be present on other components of seat 121 in addition to or instead of headrest 127.

Seat 121 contains some form of recliner operation assembly. The operation assembly comprises various combinations of operating components such as hinges, brackets, fasteners, linkages, levers, bearings, slides, pivots, springs, or pistons. The assembly operates and controls the reclining of seat 121 and attaches the seat to lockers 101*a*-101*d*, 301*a*-301*c*, 401*a*-401*c*. According to the preferred embodiment of the present application, the operation assembly is at least partially housed in and concealed by compartments of lockers 101*a*-101*d*, 301*a*-301*c*, 401*a*-401*c* such as lower compartment 133 (see FIGS. 1-2). The operation assembly may also be concealed by other locker features such as seat 121 instead of or in addition to lower compartment 133.

For seat 121 to be moved from an upright position into a reclined position, some force must be applied to the recliner operation assembly. This force may be supplied from a user, such as by applying or shifting body weight or other force, or may be supplied from components within the operation assembly such as springs, hydraulic pistons, pneumatic cylinders, and/or electric motors. Locker 101, 301, 401 may further contain some form of recliner release such as a lever, switch, handle, strap, or button, and may operate mechanically or electrically, alone or in combination with motion-arresting components, such as latches, brakes, pins, or magnets, which prevent the reclining of seat 121 until a user operates the recliner release.

Parts of seat 121 such as headrest 127 and seatback 125 may be easily removable or interchangeable. Seatback 125 may be made of multiple portions, such as an upper and lower portion, or may be a single portion. Seatback 125, whether a single portion or multiple portions, may be hinged such that the seatback portions may be moved about their respective hinges and open the seatback to allow a user to store and access equipment behind the seat. Parts of seat 121 such as headrest 127, seatback 125, and bench 123 may be ventilated and connected through lockers 101*a*-101*d*, 301*a*-301*c*, 401*a*-401*c* to plenum 303 such that air flows through seat 121 to a user. Airflow to seat 121 may be warm or cool air and may be used to cool or warm a person sitting in seat 121. Seat 121 may also be heated or cooled with other components, such as electrical heating elements, used alone or in combination with ventilation.

The interior area of lockers 101*a*-101*d*, 301*a*-301*c*, 401*a*-401*c* further contains a lower compartment 133 (see FIGS. 1-2). In the preferred embodiment according to the present application, compartment 133 serves as a housing for the recliner operational assembly for seat 121. Compartment 133 has a front panel 135 that conceals the assembly within the compartment. In an alternative embodiment, compartment 133 may contain chamber 307 for storage of roll-up door 107 instead of or in addition to housing and concealing components of a recliner operational assembly (not shown). In other embodiments, compartment 133 may be a functional footlocker wherein front panel 135 opens to allow access to the compartment, or wherein compartment 133 is actually a drawer that slides forward from underneath seat 121. Front panel 135 is depicted as containing apertures or vents through the panel. In the preferred embodiment according to the present application, these apertures or vents may be used in combination with the plenum 303 and other ducting to ventilate lockers 101*a*-101*d*, 301*a*-301*c*, 401*a*-401*c*.

The interior area of lockers 101*a*-101*d*, 301*a*-301*c*, 401*a*-401*c* further contains various features designed to help store and organize equipment and apparel. For example, in the preferred embodiment according to the present application, lockers 101*a*-101*d*, 301*a*-301*c*, 401*a*-401*c* contain a game day hook 117 (see FIGS. 1-5). Game day hook 117 preferably is removably mounted inside and at the top of the interior area of lockers 101*a*-101*d*, 301*a*-301*c*, 401*a*-401*c* in front of compartment 111. Game day hook 117 may be easily installed and removed such that hook 117 is only present on days when a user will be wearing game-day equipment. Game-day equipment may be hung in locker 101, 301, 401 before a game or event, after which hook 117 is removed, until the next game or event. Lockers 101*a*-101*d*, 301*a*-301*c*, 401*a*-401*c* also contain interior equipment hooks 119. Referring to FIG. 1, lockers 101*a*-101*d*, 301*a*-301*c*, 401*a*-401*c* preferably contain a plurality of hooks 119 mounted on the front surface of back wall 105. Hooks 119 may be mounted elsewhere within lockers 101*a*-101*d*, 301*a*-301*c*, 401*a*-401*c*, such as on lockers 101*a*-101*d*, 301*a*-301*c*, 401*a*-401*c* sidewalls on the interior area and within compartments 111, 147. Hooks 117 and 119 may be made of various materials such as metal, wood, laminate, composite, or polymer, depending on the designs of lockers 101*a*-101*d*, 301*a*-301*c*, 401*a*-401*c* and the type of equipment that will be stored on hooks 117, 119.

To the side of the interior area, lockers 101*a*-101*d*, 301*a*-301*c*, 401*a*-401*c* preferably contain shoe storage compartment 137. Referring now also to FIG. 5, shoe-storage compartment 137 includes a pair of spaced-apart, opposed or opposing front and rear end walls 501, which are connected at the top and bottom. Heavy-duty drawer slides 503 may be mounted at the top and bottom of end walls 501 and are secured to the interior of sidewalls 103 to permit compartment 137 to slide or move between extended (see FIG. 5) and retracted positions (as shown in FIGS. 3A-C and 4). Slides 503 may be located elsewhere along the vertical dimension of compartment 137, as well. Compartment 137 may vary in height, width, and depth but should be large enough in all dimensions to accommodate at least one pair of shoes and preferably two or more pairs. Compartment 137 may be provided with illumination in the form of LED lights or other illumination sources. Such illumination may be controlled by switches that turn the illumination on or off as compartment 137 is opened and closed.

As shown in FIG. 5, a plurality of pairs of generally opposed or opposing projections 505 are secured to end walls 501 in a slightly staggered fashion. Projections 505 serve to temporarily secure and support shoes in a storage position within compartment 137. In the preferred embodiment according to the present application, projections 505 are designed to support shoes from underneath, but in other embodiments may support footwear by fitting inside the footwear and holding the footwear either upright or upside down. Projections 505 preferably are formed of sheet stainless steel, bent at an angle, with a vertical portion riveted, screwed, or otherwise fastened to end walls 501. Projections 505 may be shorter or longer than illustrated to accommodate different sizes or types of shoes (e.g. provided with notches for "flip flops," or shaped differently to accommodate boots or other high-topped shoes) and to accommodate gloves (with or without individual finger projections). Projections 505 may be provided with electric resistance or other heating elements to assist drying of shoes or other equipment. Projections 505 may be provided with anti-odor, anti-fungal, or anti-bacterial coatings or inserts to prevent odor or infections. Projections 505 may also be adjustable as to length or angle via hinges and other mechanisms so that projections 505 can be customized to accommodate different types of shoes, gloves, and other equipment. Projections 505 may also be hollow and connected to a forced-air ventilation system to provide additional air circulation within and about any footwear or equipment contained in compartment 137.

At least one side of compartment 137 must be open-faced when compartment 137 is extended from lockers 101*a*-101*d*, 301*a*-301*c*, 401*a*-401*c* to permit access to projections 505. A perforated rear wall 507 may extend between end walls 501 to add strength to enclosure or compartment 137. The perforations permit air circulation to allow stored shoes to dry. Air may be supplied to compartment 137 by a forced-air ventilation system (either wholly or partially self-contained or coupled to building HVAC). Such ventilation may include anti-odor, anti-fungal, or anti-bacterial treatments. A removable debris tray 509 may be disposed at the bottom of enclosure 137 to catch mud, grass, and other debris from shoes stored in compartment 137. Tray 509 may be removed and debris emptied and replaced.

In operation, the user pulls shoe compartment 137 from the retracted position into the extended position by using handle 139. The user places recently worn, dirty, and sweaty or otherwise wet shoes onto projections 505. Compartment 137 then may be closed, and any shoes or equipment contained within compartment 137 will dry. Any dried mud or grass or other debris falling from shoes may land on tray 509, which may be removed for disposal of the debris. Components of shoe storage compartment 137 may be made of various materials such as metal, wood, laminate, composite, or polymer, depending on the designs of lockers 101*a*-101*d*, 301*a*-301*c*, 401*a*-401*c*. In the preferred embodiment according to the present application, compartment's 137 components are primarily made of stainless steel.

In the preferred embodiment according to the present application, compartment 137 is shown as being to the right of the reclining seat 121 and interior area as seen from the front of lockers 101*a*-101*d*, 301*a*-301*c*, 401*a*-401*c*, but could be mounted to the left instead. Other embodiments may have multiple compartments 137, located on either or both sides of seat 121. In the preferred embodiment, compartment 137 extends from the base of lockers 101*a*-101*d*, 301*a*-301*c*, 401*a*-401*c* to the bottom edge of overhead compartment 147, but in other embodiments could be shorter to allow more usable space for the rest of lockers 101*a*-101*d*, 301*a*-301*c*, 401*a*-401*c*. For example, in other embodiments compartment 137 may extend upward only enough such that an arm rest may be mounted above compartment 137 for a user in seat 121. Compartment 137 may also be split into multiple pieces. For example, an alternative embodiment may have one enclosure for compartment 137 but contain two separate shoe storage drawers within the enclosure, one mounted above the other. Alternatively, lockers 101*a*-101*d*, 301*a*-301*c*, 401*a*-401*c* may not contain shoe storage compartment 137 at all, and may either be more compact as a result or provide a wider seat 121.

Above the interior area, lockers 101*a*-101*d*, 301*a*-301*c*, 401*a*-401*c* contain an upper panel 143. In the preferred embodiment according to the present application, panel 143 is located in front of door chamber 307 and serves to conceal door 107 when the door is in an open position. Panel 143 also serves to conceal any portion of guiding components 305 and any door operational components, such as a drive system or tension system, which are located within chamber 307.

Panel 143 preferably is removably coupled to lockers 101a-101d, 301a-301c, 401a-401c so that panel 143 may be easily removed or changed. The removable panel gives maintenance personnel easy access behind panel 143 to maintain or replace any components held behind the panel. In other embodiments, panel 143 is hinged along an upper or lower edge such that panel 143 is not completely removable but still allows easy access behind the panel, or is fixed to lockers 101a-101d, 301a-301c, 401a-401c such that maintenance personnel would need to undue fasteners such as screws or bolts to access components behind the panel.

In the preferred embodiment according to the present application, panel 143 contains a logo 145 (see FIGS. 1-2) laser etched into the front surface of panel 143 and filled with paint, ink, or other substances. This logo may be in any form, including symbols, written words, or other visual depictions.

Above panel 143 and at the top of lockers 101a-101d, 301a-301c, 401a-401c is an overhead compartment 147. This compartment is defined by the sidewalls 103 of lockers 101a-101d, 301a-301c, 401a-401c and shelves or other horizontally extending surfaces or platforms (see FIGS. 1-2). An overhead door 149 is attached at the front of compartment 147 and is hinged along a top edge so that door 149 may be opened upwards to allow access to the contents of compartment 147.

Compartment 147 preferably contains a door opening mechanism (not shown) wherein components such as springs, hydraulic pistons, levers, pivots, other components, or any combination thereof are used to apply an opening force to overhead door 149. Depending on the magnitude of the opening force supplied to door 149, and on the design of the opening mechanism, overhead door 149 may stay closed when put in a closed position and stay open when placed in an open position without the use of a releasable fastener, or door 149 may use some type of releasable fastener like a latch or magnet to hold door 149 in a closed position.

In other embodiments, compartment 147 may not contain any components which assist in the opening of door 149, and may contain other features or components which hold door 149 open when door 149 is put in an open position.

Overhead door 149 preferably comprises a border panel 151 and a lighted panel 153. Lighted panel 153 may have backlighting attached to door 149 behind panel 153, or panel 153 may simply be a translucent or transparent panel that is illuminated by lights within compartment 147. In other embodiments, panel 153 may not be lighted and instead may be an opaque material such as wood, metal, or laminate. In the preferred embodiment, a logo 159 is attached to border panel 151 in front of lighted panel 153. Other embodiments, overhead door 149 may not contain a logo 159.

Overhead compartment 147 preferably contains an extending and retracting shoe shelf 155 (see FIGS. 1-2). Shelf 155 slides forward partially out of compartment 147 and pivots down toward a user so that a user has easier access to shoes or other equipment or items stored on shelf 155. Compartment 147 also preferably contains ventilation apertures or a grille 157 through back wall 105 to allow ventilation created by fans or an HVAC system through plenum 303 to circulate air in compartment 147. This circulation in overhead compartment 147 helps dry or keep fresh any shoes or other gear and equipment kept in overhead compartment 147.

Lockers 101a-101d, 301a-301c, 401a-401c preferably contain additional features on the exterior. Referring to FIGS. 1-4, display panel 141 is present on the front of lockers 101a-101d, 301a-301c, 401a-401c. In the preferred embodiment according to the present application, display panel 141 is located on the front of shoe storage compartment 137. In other embodiments, display panel 141 may be located at any exterior point on lockers 101a-101d, 301a-301c, 401a-401c.

Display panel 141 is shown as a simple backlit panel with an image, but display panel 141 should be understood to include any kind of display. For example, display panel 141 may be a programmable electronic display wherein the display is controlled individually and in series with display panels 141 on other lockers 101a-101d, 301a-301c, 401a-401c. Display panel 141 may be an interactive programmable electronic display such as a touch-screen display, and may function to control various features and components of lockers 101a-101d, 301a-301c, 401a-401c such as lighting, ventilation, and the opening and closing, and the locking and unlocking of doors 107, 149, 113 and compartment 137. In embodiments wherein display panel 141 is a touch-screen display, control panel 403 may have limited function or may be excluded altogether.

In some embodiments, a programmable electronic display (not pictured) may be mounted on or above door 149 in place of or in addition to lighted panel 153 and logo 159. In such other embodiments, display panel 141 or control panel 403 may control the programmable display on door 149. Alternatively, a programmable display on or above door 149 may be controlled, individually and in series with other overhead displays or display panels 141 on the same or other lockers 101a-101d, 301a-301c, 401a-401c, by an external computer or other electronic device.

Lockers 101a-101d, 301a-301c, 401a-401c contain various features and components. It should be understood that certain features, such as upper panel 143, or images displayed on display panel 141 or an overhead display, are easily interchangeable. For example, displays and logos in lockers 101a-101d, 301a-301c, 401a-401c may be changed for important events such as tournaments, playoffs, championships, and bowl games. Furthermore, displayed images or logos which are specific to a certain user, such as a specific player on a team, must be changed in certain normal circumstances, such as when a player leaves a team and a new player begins using lockers 101a-101d, 301a-301c, 401a-401c. It should also be understood that any features of lockers 101a-101d, 301a-301c, 401a-401c such as any handles, locks, levers, or latches (for example: hooks 117 and 119, handle 139) may be customized to be in the shape of any logos, promotional indicia, or other specific shapes a user or organization prefers.

Figure 6A:
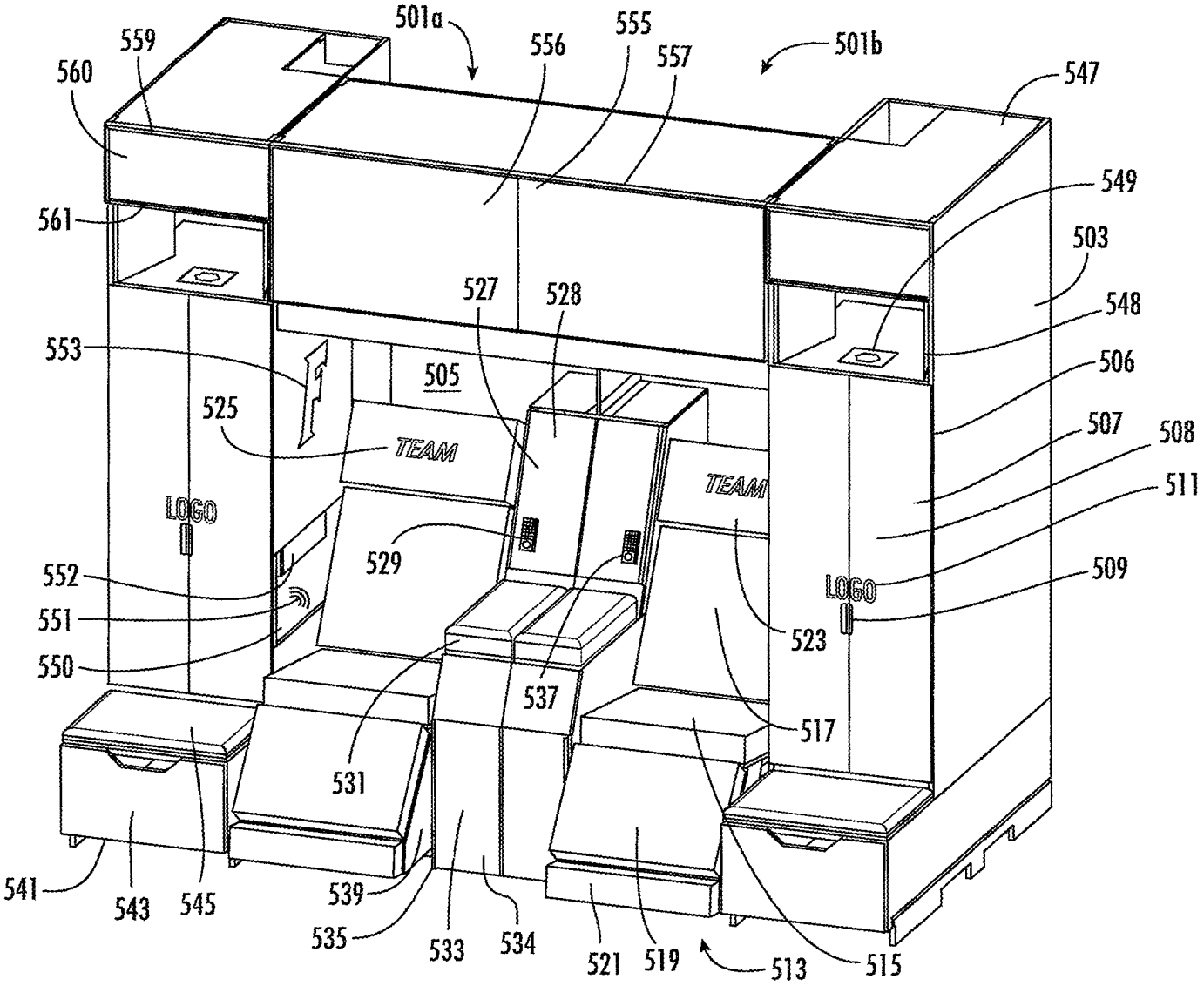
FIGS. 6A and 6B are perspective views of multiple examples of a locker according to an alternative embodiment of the present application.
Figure 6B:
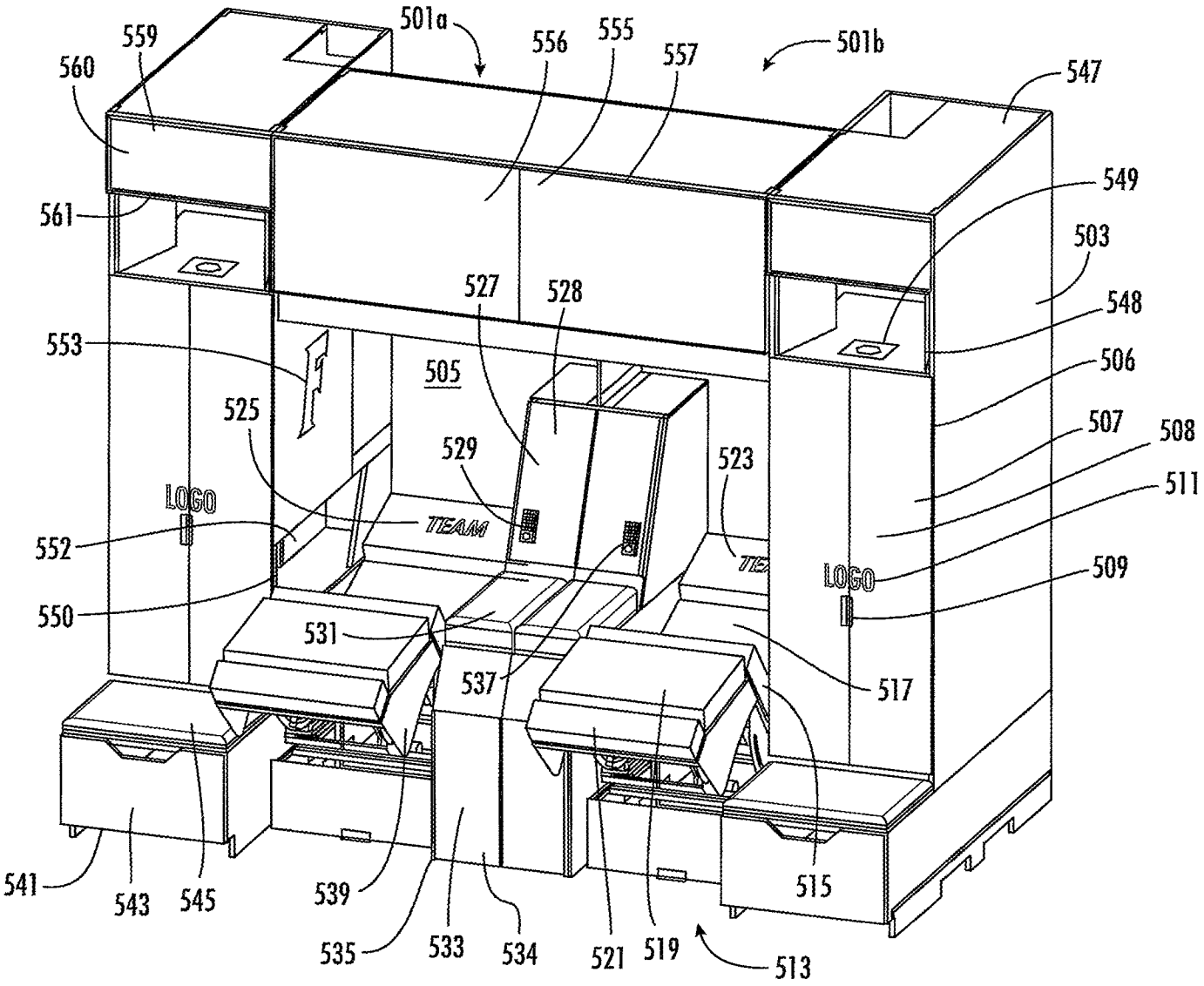

Referring now also to FIGS. 6A and 6B in the drawings, lockers 501a and 501b according to an alternative embodiment of the present application are depicted. Neither Locker 501a nor 501b are depicted with roll up door 107 from the previous embodiment though it is appreciated that a roll up door 107 may be included, with all of the potential embodiments described above, in this embodiment in order to close and secure the inner area of the lockers 501a and 501b. FIG. 6A shows both lockers 501a and 501b with a reclining seat 513 in the upright position while FIG. 6B shows seat 513 in the reclined position.

Lockers 501a and 501b generally comprise a pair of upstanding side walls 503 that generally define the extent of lockers 501a and 501b. A back wall 505 connects side walls 503 at the rear of lockers 501a and 501b and a top wall 547 connects side walls 505 at the top. Like in 101*a*-101*d*, 301*a*-301*c*, and 401*a*-401*c*, side walls 503, back wall 505, and top wall 547 may be made of various materials, including wood, laminates, polymers, metals, and composites. The material choice will depend upon the properties desired for the chosen application and embodiment of lockers 501*a* and 501*b*. Lockers 501*a* and 501*b* may be installed adjacent to another, similar, or identical lockers 501*a* and 501*b*, with lockers 501*a* and 501*b* rear against a wall, and lockers 501*a* and 501*b* front facing the interior of a locker room. Lockers 501*a* and 501*b* may also be installed behind and facing the opposite direction of another similar or identical lockers 501*a* and 501*b*, with lockers 501*a* and 501*b* rear walls against the rear wall of other lockers 501*a* and 501*b*. Other sidewalls 503, back walls 505, and top walls 547 may be arranged to create interior areas of lockers 501*a* and 501*b*. Lockers 501*a* and 501*b* may not be symmetrical in design as shown in FIGS. 6A and 6B and a seating area may be formed by putting lockers 501*a* and 501*b* in the formation currently shown, but lockers 501*a* and 501*b* may also be installed in a way where this seating area is not formed.

Between the sidewalls 503 of lockers 501*a* and 501*b*, a plurality of compartments 506 are defined by shelves or other horizontally extending surfaces or platforms. As used herein, "sidewall" or "sidewalls" may refer to either "main" sidewalls 503 or other upstanding or generally vertical sidewalls arranged between the "main" sidewalls. Multiple additional sidewalls 503 may be placed between the "main" or exterior sidewalls 503 to define general compartments 506 in cooperation with generally horizontally extending shelves or platforms. The sidewalls and shelves of compartments may be made of the same materials as sidewalls 503 and back walls 505, or may be made of differing materials, depending on the desired properties of the specific application and embodiment of lockers 501*a* and 501*b*. Each compartment 506 may be sized and otherwise configured for storage of clothing or sporting equipment or other items and may include doors which may be lockable. Compartments 506 may also include features such as electrical outlets or charging ports.

A plenum from the previous embodiment is not currently shown in the new embodiments of lockers 501*a* and 501*b*. It is however appreciated that lockers 501*a* and 501*b* may be built with a plenum 303 attached to back wall 505. If used, plenum 303 would be used in the same way that plenum 303 was used in the previous embodiment to facilitate airflow through lockers 501*a* and 501*b* and the users will have ways in order to control that flow.

The interior area of lockers 501*a* and 501*b* contain compartment 507 connected to main side wall 503. Compartment 507 contains two doors 508 with each door 508 having a handle 509 that the user can use to open it. These doors may also be locked to secure the contents of compartment 507. Doors 508 may also have an emblem or logo 511 on them which allows the user to customize lockers 501*a* and 501*b* to represent their team. Compartment 507 may be sized or shaped in order to fit equipment or compartment 507 may be designed in order to be shoe storage compartment like in the previous embodiment. On the inside wall of compartment 507 there is cubby 548 which indents slightly into compartment 507. Inside cubby 548 there is panel 552 which can be used to control reclining seat 513 and there is also charging station 551 where users can place their electronic devices in order to charge them wirelessly. Beneath compartment 507 is lower compartment 541 which has a front plate 543 with a notch at the top of front plate 543 which allows the user to pull the compartment out like a drawer. On top of lower compartment 541 there is cushion 545 which provides another area for a user to sit when in the locker room if the user does do not wish to sit in reclining seat 513. Lower compartment 541 may be used to store shoes, bags, or other small pieces of equipment or personal items and, like door 508 of compartment 507, front plate 543 may be locked to secure these items.

The interior area of Lockers 501*a* and 501*b* also contain upper compartment 559 and upper middle compartment 555. Upper compartment 559 is located above compartment 507, connects side wall 503, and extends down from top wall 547. Upper compartment 559 has door 560 which has handle 561 on the bottom of door 560 which the user can use to open door 560 from the bottom. Compartment 559 may be configured and dimensioned in order to store small equipment, and like the other compartments, compartment 559 may be locked to secure what is inside. There is a space between the bottom of compartment 559 and the top of compartment 507 that forms cubby 550. Cubby 550 is used to help with ventilation of lockers 501*a* and 501*b* by having a section of lockers 501*a* and 501*b* open to the air. On top of compartment 507 is vent 549 which in combination with cubby 550 helps maintain the circulation of air through lockers 501*a* and 501*b*. On the side of compartment 559 is the upper middle compartment 555 which is also comprised of a door 556 and a handle 557 and extends out for the rest of the length of lockers 501*a* and 501*b*. Compartment 559 is also designed in order to fit equipment or personal items that the user wishes the store above them and door 556 may also be locked to secure these items.

The interior area of lockers 501*a* and 501*b* may also further contain various features designed to help store and organize equipment and apparel such as the features in the previous embodiment. These features may be built into the walls of lockers 501*a* and 501*b* or they may be removable depending on the situation in which they are needed. Also, on the inside side walls 503 of compartment 507, a user will be able to include customization 553 where they can put different symbols, words, or letters to represent their team on their lockers 501*a* and 501*b*.

Reclining seat 513 is inserted next to the interior side of compartment 507 and on the other side of reclining seat 513 are middle compartment 527 and lower middle compartment 533. Middle compartment 527 forms the other edge of lockers 501*a* and 501*b* and middle compartment 527 is a slightly slanted compartment which is comprised by a door 528, a handle 529, and a locking mechanism 537. Locking mechanism 529 shown in the present application is a keypad combination which the user puts their code in to unlock compartment 527, however it is appreciated that this door could be unlocked by an app, a radio signal, or a simple key if a non-technical lock is used. Compartment 527 is configured in order to fit smaller equipment or personal items of the user that they wish to secure. Lower middle compartment 533 is beneath middle compartment 527 and lower middle compartment 533 also comprises a door 534 and a handle 535. Compartment 533 is also configured in order to fit smaller equipment or personal items and door 534 may also include a lock in order for the user to secure their belongings. On top of compartment 533 is padded arm rest 531 which is a place a user can rest their arms while sitting in seat 513.

Figure 7:
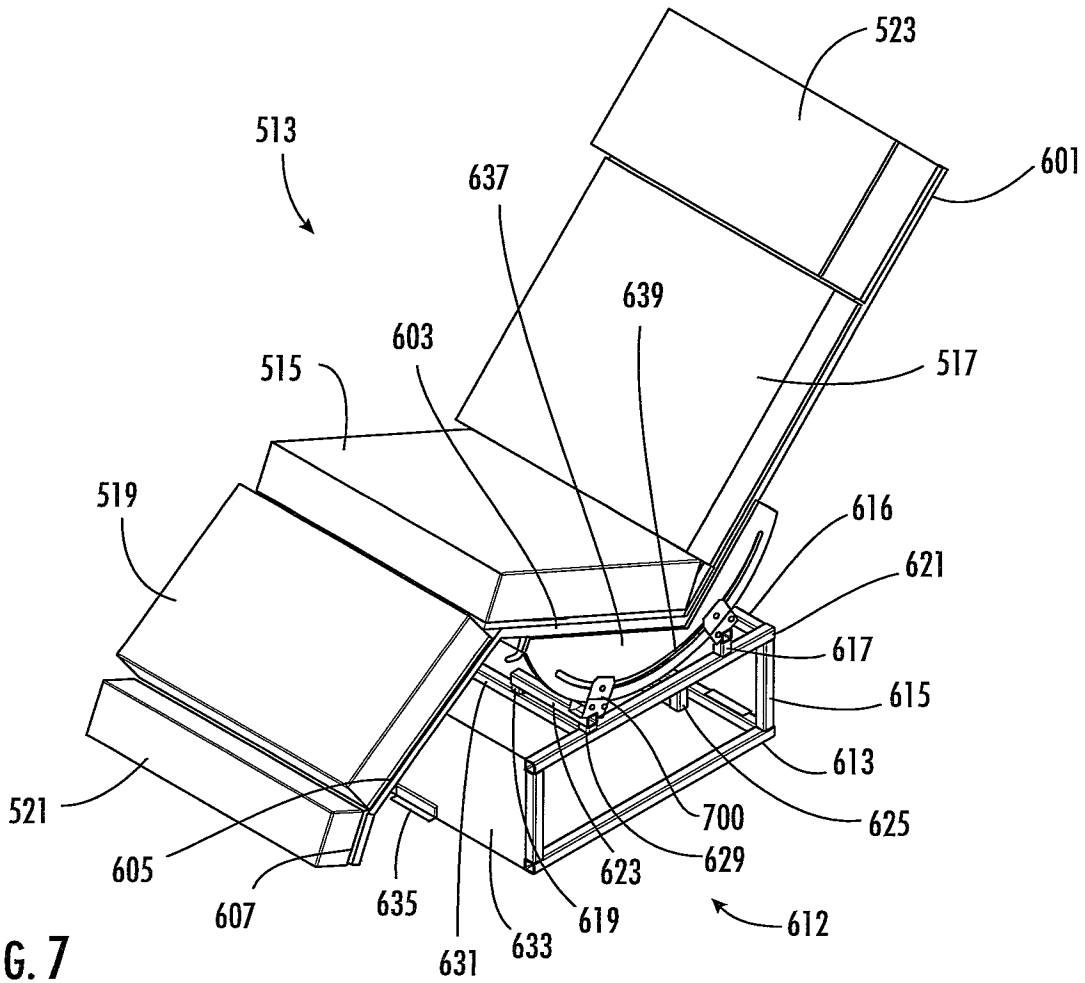
FIG. 7 is a perspective view of the reclining seat according to an alternative embodiment of the present application.
Figure 8:
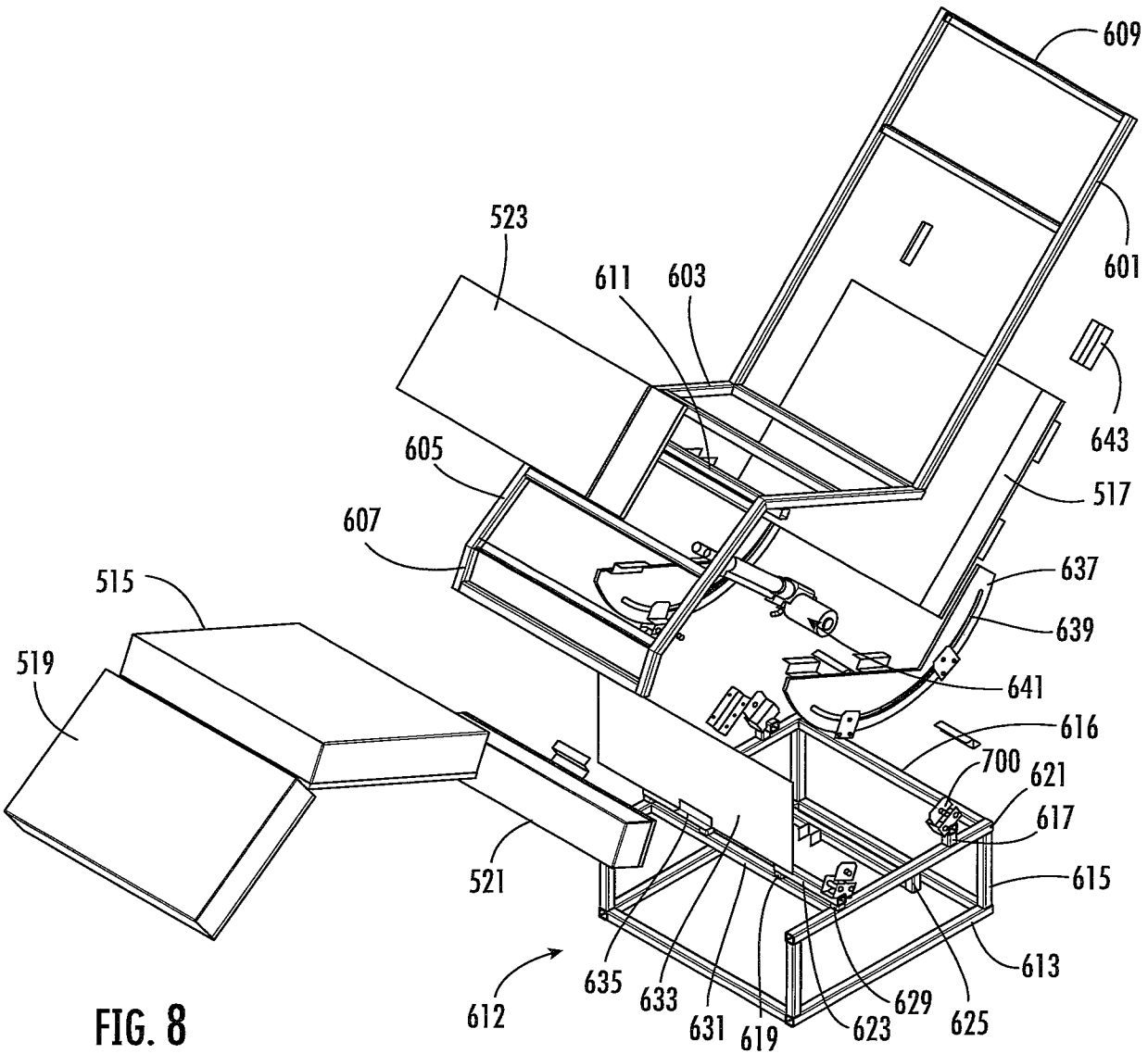
FIG. 8 is an exploded view of the reclining seat according to an alternative embodiment of the present application.

Referring now also to FIGS. 7 and 8 in the drawings, an exploded view of reclining seat 513, according to the alternative embodiment of the present application is depicted. Reclining seat 513 is modular and is not connected to locker 501*a* and 501*b* so reclining seat 513 may be inserted or removed from lockers 501*a* and 501*b* depending on the desire of the user. Connected to the sides of reclining seat 513 near the foot rest is protection plate 539 which is used to protect the insides of the chair base when reclining seat 513 is inserted into lockers 501*a* and 501*b*. Reclining seat 513 is hydraulic and may be reclined either by force or by using a motor to set seat 513 into the desired position. In the current embodiment, seat 513 is zero gravity, as in the seat as a whole moves when reclining instead of the individuals parts, however, in another embodiment, different sections of seat 513 can be capable of movement independent of the entire seat 513. In the other embodiment where sections of seat 513 may be moveable independent of the entire seat 513, compartments 506 may be inserted behind the head rest and foot rest of seat 513. This can be done either through a panel next to the seat, an app, or other device located somewhere on lockers 501*a* and 501*b*. Reclining seat 513 is comprised of a seat cushion 515, a back cushion 517, upper leg cushion 519, lower leg cushion 521, and head rest 523. FIGS. 6A and 6B show that head rest 523 may be customized to include emblems 525 of the team or other logos, however, it is appreciated that any section of seat 513 may include one of these emblems 525. FIG. 8 shows an exploded view of seat 513 and how the cushions are connection to the frame and how seat 513 reclines.

Figure 9:
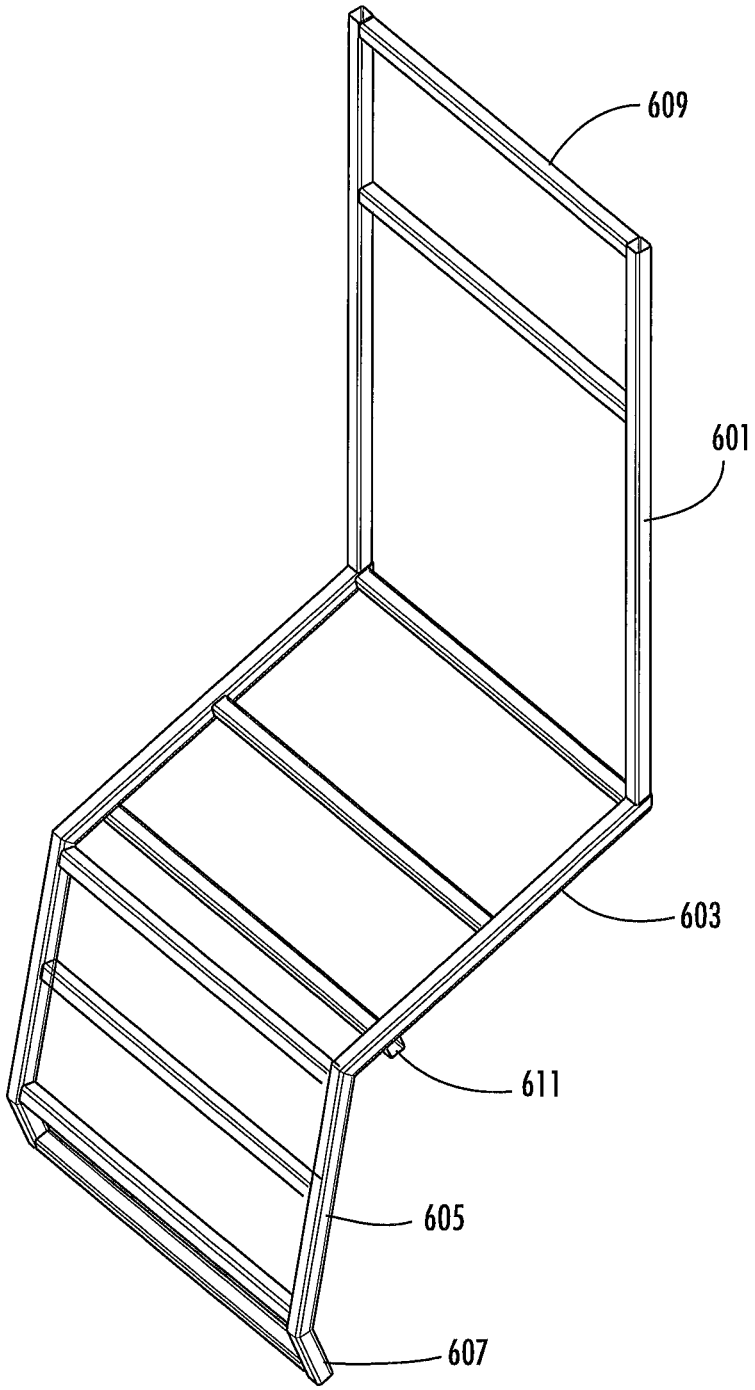
FIG. 9 is a perspective view of a section of the reclining seat according to an alternative embodiment of the present application.

Referring now also to FIG. 9 in the drawings, a section of the exploded view of seat 513, according to the alternative embodiment of the present application is depicted. FIG. 9 shows the frame of seat 513 that cushions will be attached to. The frame is broken into four sections corresponding to sections of the cushions. The upper section comprises the location of head rest 523 and back cushion 517 and this place has two hollow parallel bars 601. The second section corresponds to the location of the seat cushion 515 and has two hollow parallel bars 603 attached perpendicularly to the end of bars 601. The third section corresponds to the location of upper leg cushion 519 and has two hollow parallel bars 605 which connect at an angle to the ends of bars 603. The final section corresponds to the location of lower leg cushion 521 and has two hollow parallel bars 607 which connect at an angle to the ends of bars 605. Running across the parallel bars are hollow support bars 609 which connect to the sides of the other bars and runs the length between them to provide extra support to the cushions. These bars may be connected to each other either by being welded together or by using fasteners. The cushions are attached to these bars by fastener plate 643, shown in FIG. 8, which uses fasteners to secure the cushions in place. Towards where bars 603 and 605 connect, there is a different support bar 611 which instead connects to the bottom of the parallel bars instead of to the sides of them. Bar 611 is used to connect this frame to the system used to recline the seat.

Figure 10:
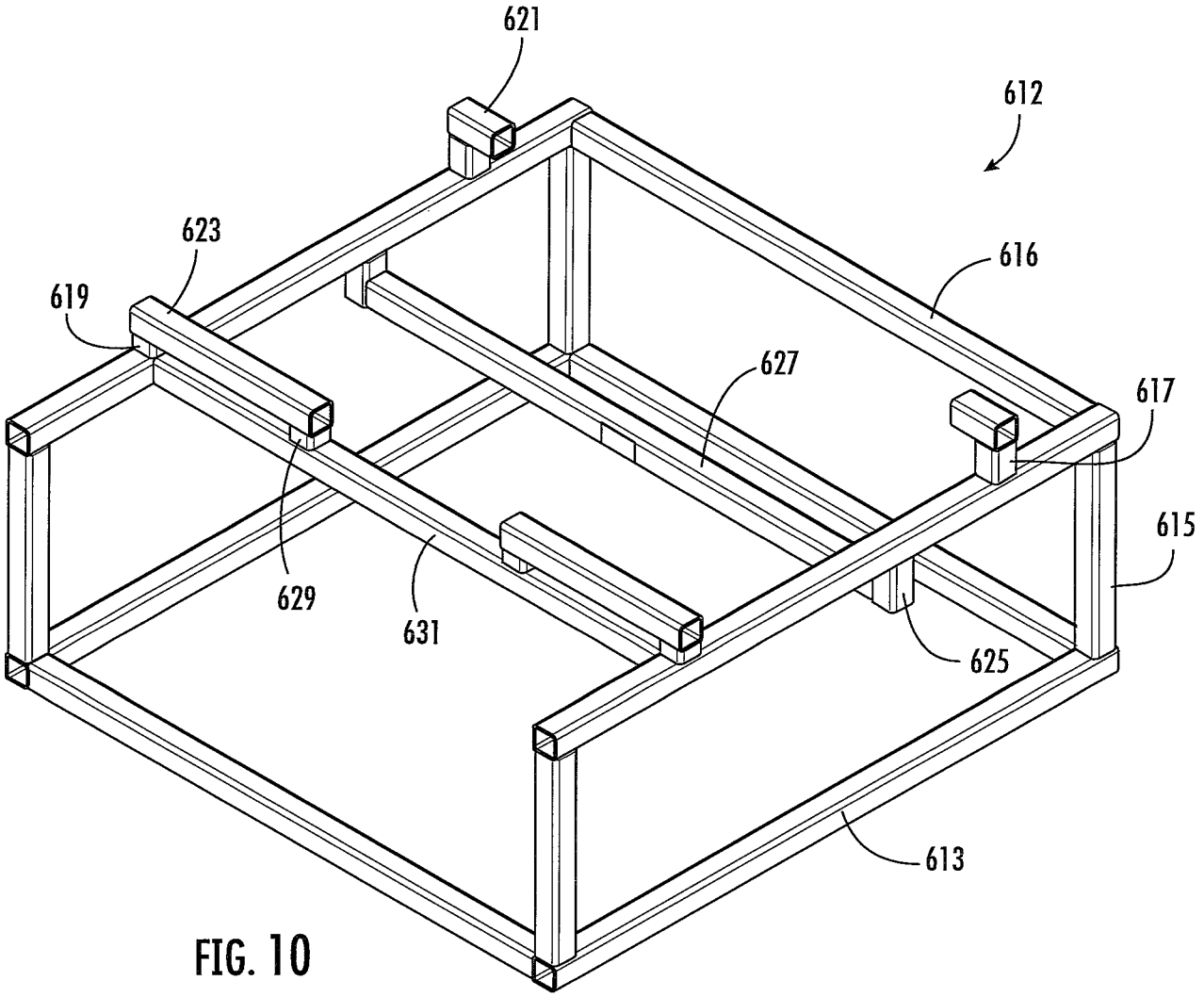
FIG. 10 is a perspective view of a section of the reclining seat according to an alternative embodiment of the present application.

Referring now also to FIG. 10 in the drawings, a section of the exploded view of seat 513, according to the alternative embodiment of the present application is depicted. FIG. 10 shows base 612 that connects to 513 and provides stability to the system either by being latched to the ground or by latching the sides of base 612 to locker 501. Base 612 is comprised of four lower support bars 613 which connect to each other to form the square bottom of base 612. Attached at the vertices of the square bottom are vertical bars 615 which extend vertically up until they connect to the three upper support bars 616. Upper support bars 616 are in the same shape as lower support bars 613 except that there is no front bar completing the square. Towards the back of bars 616 there is upper vertical bar 617 connected to the top of bars 616 which connects to side bar 621 which extends out towards the center of the base before stopping. Side bar 621 is one of the locations where the mechanism used to recline seat 513 is attached and this provides a secure base for it. Towards the middle of base 612 there is downward vertical bar 625 which connects to the bottom of bars 616 which further connects to support bar 627 which extends the length between the two parallel bars 616. Support bar 627 provides support and stability for the system once chair 513 is installed onto base 612. Towards the front of the upper section of the base there is another support bar 631 which extends across the base from the sides of bars 616. Where support bar 631 connects to bars 616, smaller vertical bar 619 extends vertically up from the top of bars 616, though not as far up as bars 617. Connected to the top of bar 619 is longer side bar 623 which extends out along the length of support bar 631 before being connected to support bar 631 by connecting bar 629. Side bar 623 is used for the same purpose as bar 621. All of the bars that form base 612 may be connected together by fasteners or by being welded together.

Figure 11A:
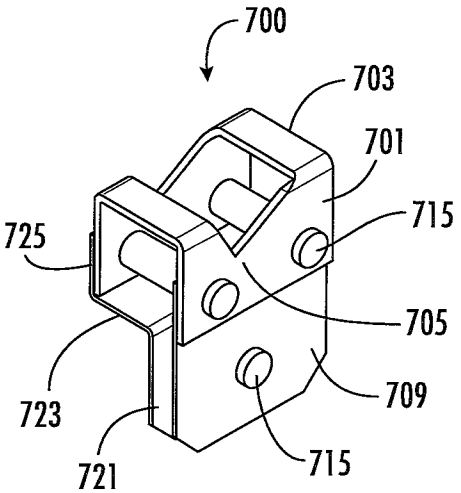
FIGS. 11A, 11B, 11C, and 11D are exploded views of a section of the reclining seat according to an alternative embodiment of the present application.
Figure 11B:
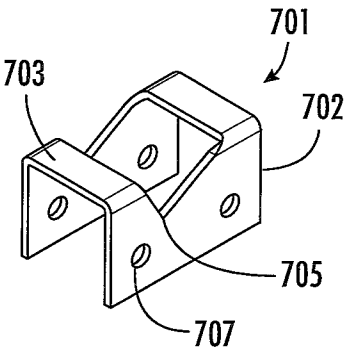
Figure 11C:
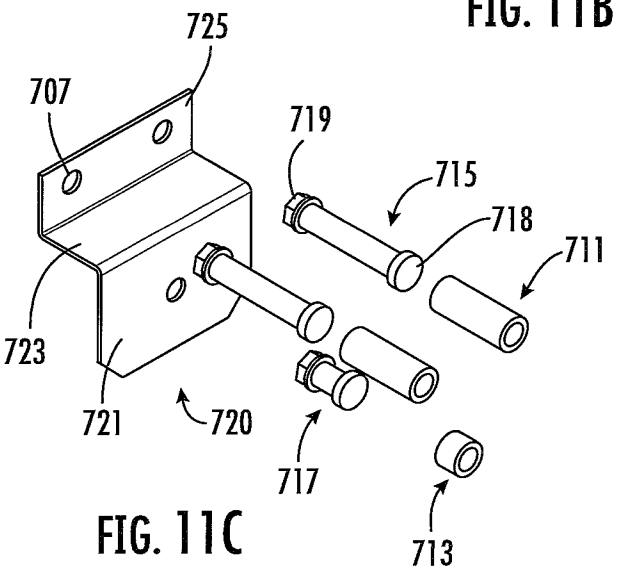
Figure 11D:
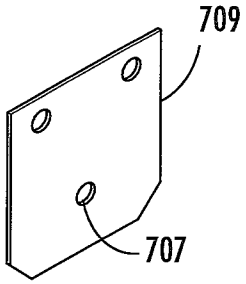

Referring now also to FIGS. 11A, 11B, 11C, and 11D in the drawings, a section of the exploded view of seat 513, according to an alternative embodiment of the present application is depicted. FIG. 11A shows the entirety of support bracket 700 with every plate attached together. FIG. 11B shows upper part 701 of bracket 700 which comprises side walls 702, an upper portion 703, a V-shaped divot 705, and holes 707. Upper portion 703 and side walls 702 are connected together and the connecting edges are smoothed over. Divot 705 cuts into upper portion 703 and side walls 702 removing a wedge from the piece. FIG. 11C depicts back support plate 720 which is comprised of lower vertical section 721, horizontal section 723, upper vertical section 725, and holes 707. FIG. 11D shows front plate 709 which is a single plate with three holes 707 in it, two of holes 707 being towards the straight top side of plate 709 and the last one being towards the segmented bottom of plate 709. FIG. 11A depicts how all of these pieces are put together. Longer support bars 715 and shorter support bars 717 are inserted through the holes of the plates along with longer bar covers 711 and shorter bar covers 713. These bars have stoppers 718 on one end which prevent them from going all the way through the holes and then they are secured to the plates on the other end using nuts 719 to secure them in place. FIG. 11A shows the system with these bars secured in place and how the system of FIG. 11A looks all together. Bar covers 711 and 713 are used to protect the supports to prevent undue wear and tear from breaking them so that way seat 513 maintains stability. Once bracket 700 is formed, bracket 700 will connect to the side bars 621 and 623 on the base which will be used to connect the base to the rest of seat 513.

Referring back to FIG. 8 shows all of the systems together and where they are located to form reclining seat 513. FIG. 8 also provides a look at curved base 637 which has curved groove 639 running parallel to the curved edge. Curved base 637 connects to the top of bar 603. Bracket 700 is then connected into groove 639 using the bottom section of plate 709. Shorter support bar 717 is slotted through groove 639 at two locations on each side which provides extra support for seat 513 while also giving seat 513 the range of movement to be reclined at any position along that groove. FIG. 8 also shows motor 641 which used to adjust the angle that seat 513 is being reclined at. Motor 641 in the present application is a linear actuator, however, it is appreciated that motor 641 may be any other motor in order to adjust the reclining angle of seat 513. Motor 641 is also used to secure seat 513 in position so that way gravity does not pull the chair down by locking seat 513 when motor 641 is not in use. Motor 641 has an outreaching bar which connects to the bottom of seat 513 and the base of motor 641 connects curved base 637. Motor 641 may be used in the current embodiment to move the entirety of seat 513 into the reclined or upright position, or, in an alternative embodiment, motor 641 may be used to move individual sections of seat 613 into the reclined or upright position independent of the other sections. FIG. 8 also shows compartment door 633 with handle 635 which can be used to the front of the base to create another compartment to store materials under the seat or as just a way to secure the inner workings of seat 513.

Figure 12:
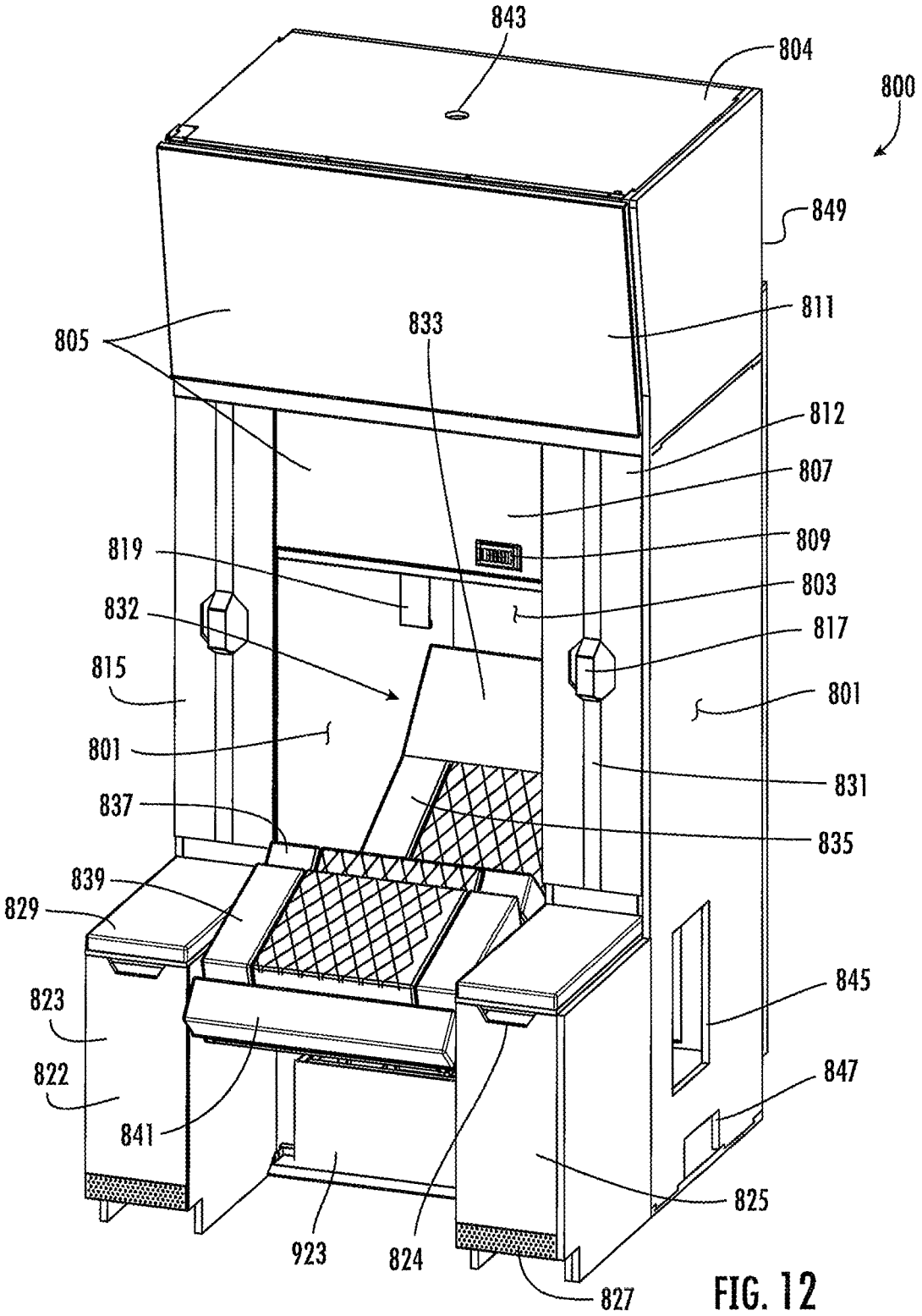
FIG. 12 is a perspective views of a locker according to an alternative embodiment of the present application.
Figure 13:
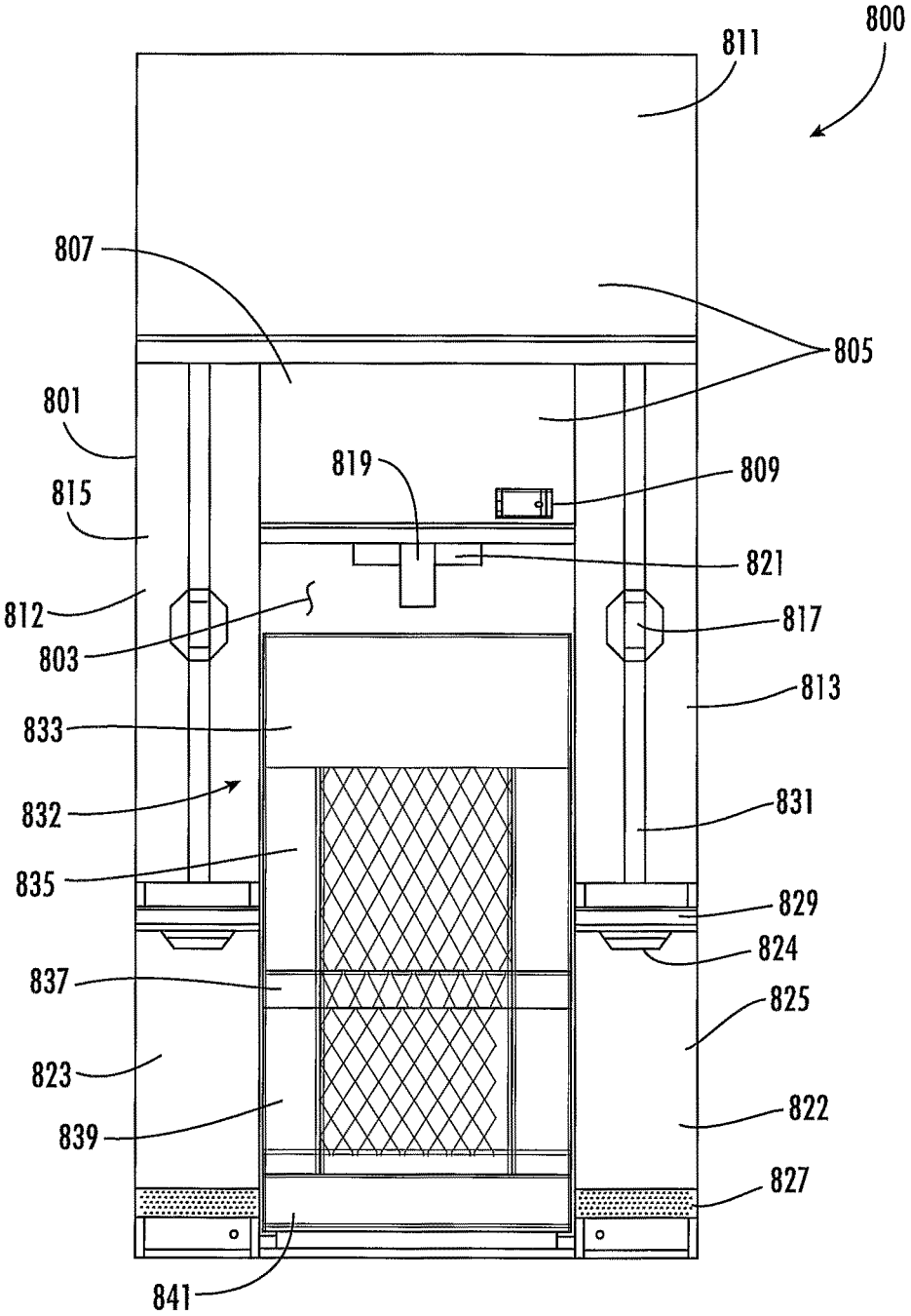
FIG. 13 is a front view of a locker according to an alternative embodiment of the present application from FIG. 12.

Referring now also to FIGS. 12 and 13 in the drawings, locker 800 according to an alternative embodiment is depicted. Locker 800 is not depicted with roll up door 107 from the previous embodiment however, it is appreciated that a roll up door may be included, with all of the potential embodiments described above, in this embodiment in order to close and secure the inner area of locker 800. As seen in these figures locker 800 is comprised of a pair of upstanding side walls 801, back wall 803, top wall 804, compartments 805, lower compartment door 807, compartment door lock 809, upper compartment door 811, side compartment doors 812, upper shoe storage compartment 813, upper cabinet 815, side compartment door handles 817, game day hook 819, electronic device holder 821, lower compartment doors 822, lower cabinet 823, lower compartment door handle 824, lower shoe storage compartment 825, door ventilation apertures 827, arm rests 829, colored side compartment stripes 831, seat assembly 832, seat head rest 833, seat back 835, seat cushion 837, a leg rest 839, a footrest 841, top hole 843, seat access opening 845, front side lift opening 847, back wall extension 849, and seat support base 923. Seat access opening 845 is an opening in the side of locker 800 to allow an individual providing maintenance to access the mechanical and electronic mechanisms inside of locker 800. While not shown in these figures, seat access opening 845 usually has a panel blocking access into opening 845 when repairs are not being made to prevent unwanted objects from getting into the inner mechanisms of locker 800.

Locker 800 is generally comprised of a pair of upstanding side walls 801 that generally define the extent of locker 800. A back wall 803 connects side walls 801 at the rear of locker 800 and a top wall 804 connects side walls 801 at the top. Like in lockers 101*a*-101*d*, 301*a*-301*c*, and 401*a*-401*c*, side walls 801, back wall 803, and top wall 804 of locker 800 may be made of various materials, including wood, laminates, polymers, metals, and composites. The material choice will depend upon the properties desired for the chosen application and embodiment of locker 800. Each locker 800 may be installed adjacent to another, similar, or identical locker 800, with locker's 800 back wall 803 against a wall, and locker's 800 front facing the interior of a locker room. Each locker 800 may also be installed behind and facing the opposite direction of another similar or identical locker 800, with locker's 800 back wall 803 against the back wall 803 of another locker 800. Other sidewalls 801, back walls 803, and top walls 804 may be arranged to create interior compartments 805 inside locker 800. Locker 800 further has back wall extension 849 which extends the depth that locker 800 has and allows an individual to lean back further on chair assembly 832.

Between the sidewalls 801 of locker 800, a plurality of compartments 805 are defined by shelves or other horizontally extending surfaces or platforms. As used herein, "sidewall" or "sidewalls" may refer to either "main" sidewalls 801 or other upstanding or generally vertical sidewalls arranged between the "main" sidewalls 801. Multiple additional sidewalls 801 may be placed between the "main" or exterior sidewalls 801 to define general compartments. 805 in cooperation with generally horizontally extending shelves or platforms. The sidewalls and shelves of compartments may be made of the same materials as sidewalls 801 and back walls 803, or may be made of differing materials, depending on the desired properties of the specific application and embodiment of locker 800. Each compartment 805 may be sized and otherwise configured for storage of clothing or sporting equipment or other items and may include doors which may be lockable. Compartments 805 may also include features such as electrical outlets or charging ports.

Located between the pair of sidewalls 801 are lower compartment door 807 and upper compartment door 811 which protect the insides of compartments 805. Lower compartment door 807 fits between shoe storage compartment 813 and cabinet 815 and has compartment door lock 809. Compartment door lock 809 may either be a simple lock and key system or door lock 809 may be a keypad where an individual can set a customized code to unlock door lock 809. It is also appreciated that compartment door lock 809 may be remotely activated by either an electronic app or an external clicker device where an individual will be able to lock and unlock door lock 809 from afar. Above lower compartment door 807 is upper compartment door 811 which is wider and extends the full length between side walls 801. While upper compartment door 811 does not have compartment door lock 809 in the current drawings, it is appreciated that an alternative embodiment may exist where upper compartment door 811 will also have compartment door lock 809 to secure the items stored within the compartment.

On the inner sides of both side walls 801 are two side compartment doors 812 which close in upper shoe storage compartment 813 and upper cabinet 815. Both compartment doors 812 have side compartment door handles 817 which an individual can pull on to open doors 812. When an individual pulls on handles 817, compartment door 812 will either be pulled out like a drawer, such as with upper shoe storage compartment 813, or will swing open, such as for upper cabinet 815. Compartment doors 812 also have colored side compartment stripes 831 running the full height of compartment doors 812. Compartment stripes 831 can be colored to match the color theme of the locker room in which locker 800 will be placed or to match the personal tastes of the individual who will be using locker 800. It is also appreciated that, while not shown, an alternative embodiment may exist where side compartment doors 812 may also include compartment door lock 809 on either both doors 812, or compartment door lock 809 may be on only one side compartment door 812.

Directly below the two side compartment doors 812 are two lower compartment doors 822 which enclose lower cabinet 823 and lower shoe storage 825. The top of both lower compartment doors 822 are grooved to create lower compartment door handles 824 which are trapezoidal openings that an individual can pull on to open door 822. When an individual opens lower compartment door 822 connected to lower cabinet 823, compartment door 822 will swing open to the side. When an individual opens lower compartment door 822 connected to lower shoe storage 825, compartment door 822 will pull out forward like a drawer. Lower cabinet 823 is positioned below upper cabinet 815 while lower shoe storage 825 is positioned below upper shoe storage compartment 813. At the bottom portion of each compartment door 822 there are door ventilation apertures 827 which help facilitate airflow through the two lower compartments 805. On top of both lower cabinet 823 and lower shoe storage 825 there is arm rest cushion 829 which provide a location for an individual to rest that individual's arms while sitting upright in chair assembly 832. It is also appreciated that, while not shown, an alternative embodiment may exist where lower compartment doors 822 may also include compartment door lock 809 either on both lower doors 822, or compartment door lock 809 may be on only one lower door 822 and not the other.

Seat assembly 832 is inserted in the opening between lower cabinet 823 and lower shoe storage 825. Seat assembly 832 is modular and is not connected to locker 800 so seat assembly 832 may be inserted or removed from locker 800 depending on the desire of the user. Seat assembly 832 is comprised of a seat head rest 833, seat back 835, seat cushion 837, leg rest 839, and a footrest 841. Seat assembly 832 is hydraulic and may be reclined either by force or by using a motor to set seat assembly 832 into the desired position. In the current embodiment, seat assembly 832 is zero gravity, as in the seat, as a whole, moves when reclining instead of the individual parts. However, in another embodiment, different sections of seat assembly 832 can be capable of movement independent of the entire seat assembly 832. In the other embodiment where sections of seat assembly 832 may be moveable independent of the entire seat assembly 832, compartments 805 may be inserted behind head rest 833 and footrest 841 of seat assembly 832.

The interior area of locker 800 further contains various features designed to help store and organize equipment and apparel. For example, in the preferred embodiment according to the present application, locker 800 contains a game day hook 819. Game day hook 819 preferably is removably mounted inside and at the top of the interior area of locker 800 underneath lower compartment door 807. Game day hook 819 may be easily installed and removed such that hook 819 is only present on days when a user will be wearing game-day equipment. Game-day equipment may be hung in locker 800 before a game or event, after which hook 819 is removed, until the next game or event. The interior area of locker 800 further has electronic device holder 821 attached to the top of the interior area of locker 800. An individual will be able to attach a small personal electronic device, such as an iPad, tablets, or phones, to electronic device holder 821 which will suspend the electronic device in the air with the screen portion of the device facing downward. When the electronic device is placed inside of holder 821, an individual leaning back in seat assembly 832 will be able to look up and see the electronic device suspended within holder 821. This allows individuals to use the electronic device while the electronic device is suspended above the individual so that the individual will not have to personally hold up the electronic device while reclining in seat assembly 832.

Referring now also to FIGS. 14-17 in the drawings, locker 800 according to the alternative embodiment from FIG. 12 is depicted with the four side compartment doors open. These figures show that locker 800 further comprises compartment shelf 851, ventilated shoe storage wall 853, lower cabinet ventilation 855, upper cabinet ventilation 857, projections 859, back side lift opening 861, lower heavy duty self-closing rail 863, upper heavy duty self-closing rail 865, curved base 919, and actuator motor 933. These opened doors provide a view of the inside of locker 800 and how an individual's equipment can be stored within locker 800. Front opening 847 and back opening 861 are used together to help lift locker 800 from the side by providing an opening for an individual to insert the prongs of a forklift or other lifting apparatus into locker 800 directly.

Figure 14:
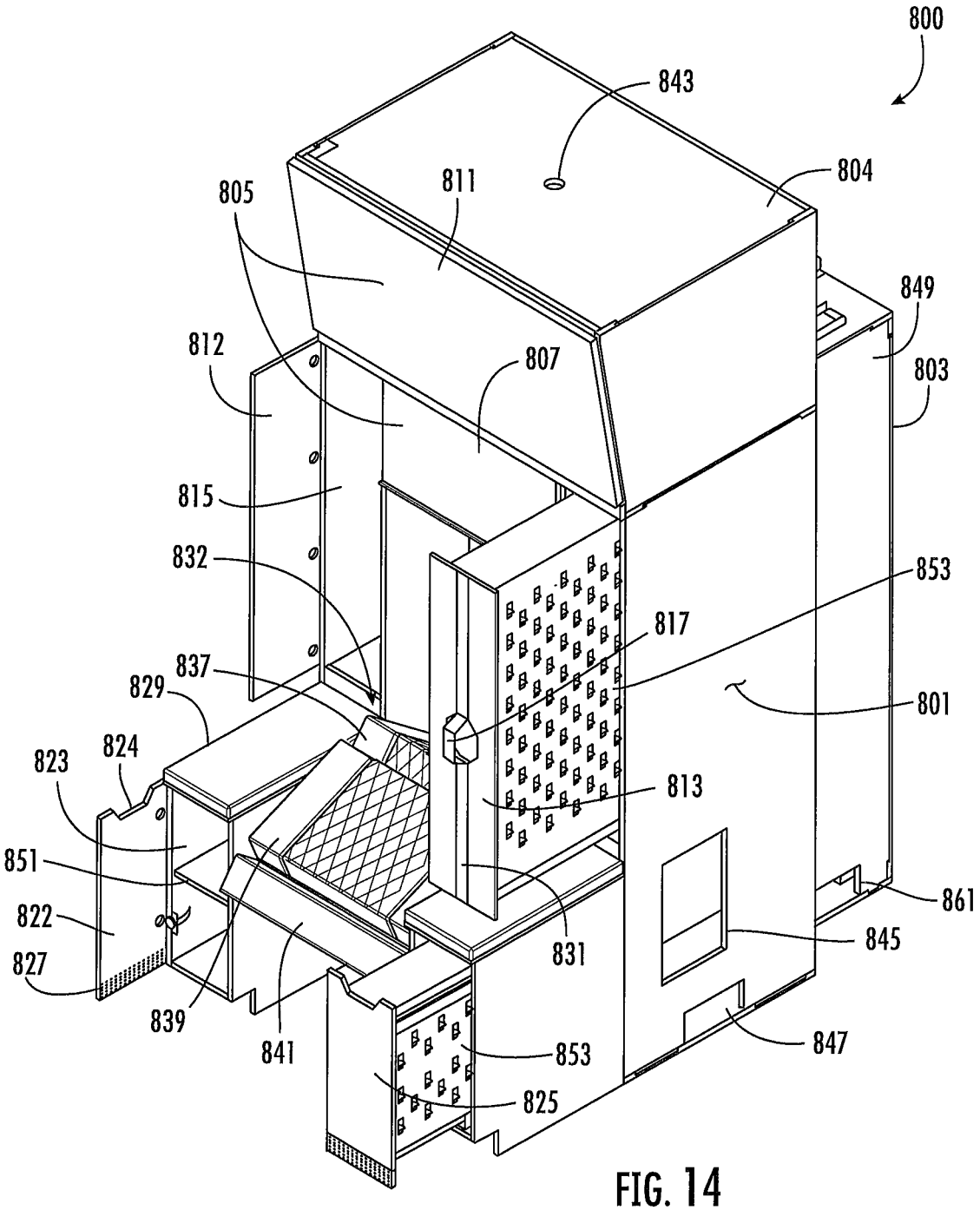
FIG. 14 is a perspective view of the alternative locker of FIG. 12, where all of the side compartment doors have been opened.
Figure 15:
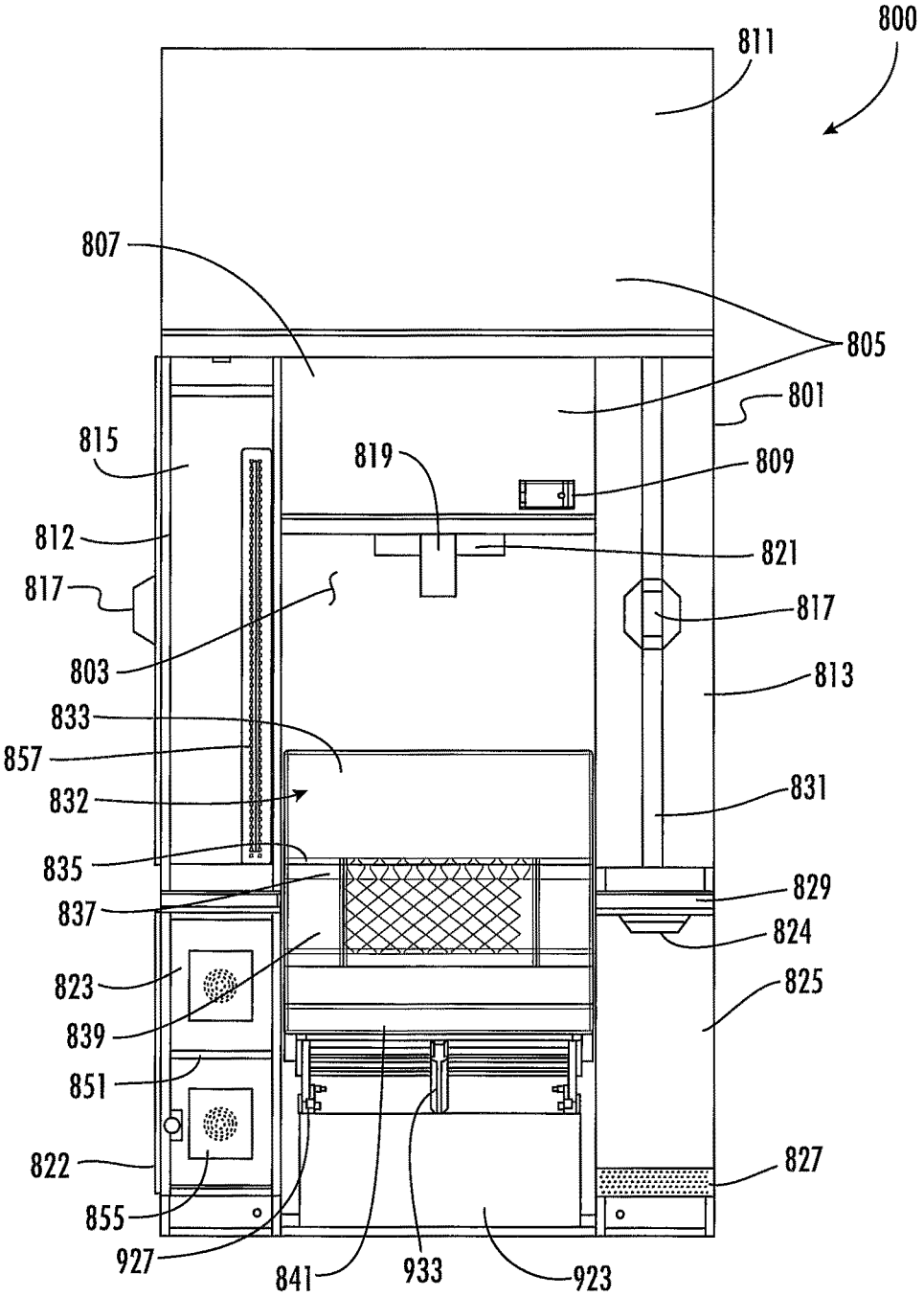
FIG. 15 is a front view of the alternative locker of FIG. 12, where all of the side compartment doors have been opened.

As shown in FIGS. 14 and 15 in the drawings, lower cabinet 823 further has compartment shelf 851 which creates two separate storage levels within cabinet 823. These separate storage levels within lower cabinet 823 provide more storage space for smaller items stored within lower cabinet 823 while also acting as a dividing wall if the individual wishes to store items separately within cabinet 823. However, it is also appreciated that an alternative embodiment can exist where cabinet 823 does not contain compartment shelf 851 which will allow an individual to store larger equipment within cabinet 823. Another alternative embodiment may also exist where more than one compartment shelf 851 may be present within lower cabinet 823 creating more isolated storage spaces within cabinet 823. While lower cabinet 823 is shown to have compartment shelf 851, upper cabinet 815 does not have compartment shelf 851 and is instead open from top to bottom. However, it is appreciated that an alternative embodiment can exist where upper cabinet 815 has one or more compartment shelves 851 disposed within upper cabinet 815. Also found within these compartments 805 is lower cabinet ventilation 855 found in lower cabinet 823 and upper cabinet ventilation 857 found within upper cabinet 815. Upper cabinet ventilation 857 is rectangular in shape and runs from the bottom of upper cabinet 315 up to almost the top of upper cabinet 315. Lower cabinet ventilation 855 is comprised of two circular ventilation openings found in lower cabinet 823 which are separated by compartment shelf 851. Both lower cabinet ventilation 855 and upper cabinet ventilation 857 will either connect with the ambient air around locker 800 for ventilation or may connect with a plenum 303 mounted on the exterior of locker 800.

A plenum 303 may be mounted on the rear or exterior side of back wall 803. While not shown in FIGS. 14 through 17, plenum 303 may be connected via duct work to the existing HVAC of the locker room in which locker 800 is disposed or situated similar to how plenum 303 is connected to locker 301*a* in FIG. 3A. The HVAC system to which plenum 303 is connected may be the conventional heating and cooling system of the building or room in which locker 800 is disposed or may be a dedicated system for locker 800. The HVAC system thus provides heated, cooled, and/or dehumidified air to locker 800 through plenum 303.

Plenum 303 may communicate air from the HVAC system to the interior and various compartments of locker 800 through a plurality of ventilation apertures such as door ventilation apertures 827 in lower cabinet doors 822, lower cabinet ventilation 855 in lower cabinet 823, and upper cabinet ventilation 857 in cabinet 815. While not shown in the current embodiment, preferably, a grille or aperture (grille is used herein to mean a single aperture or a group of apertures in any arrangement, e.g. circles, squares, other shapes, arranged in any pattern) can be arranged through back wall 803 at least at an upper extent of locker 800 to insure a supply of air to the entirety of locker 800 or at least the upper compartments thereof. The air that plenum 303 will flow through locker 800 will be used to help dry any equipment stored within locker 800 while also getting rid of any unwanted smells within locker 800.

Lower cabinet ventilation 855 and upper cabinet ventilation 857 may preferably be provided with a damper arrangement or mechanism that permits the partial closure or obstruction of the aperture(s) of lower ventilation 855 and upper ventilation 857 to control the flow of air from plenum 303. One or more front or forward ventilation grilles may be provided in the front panels or surfaces of locker 800, such as door ventilation apertures 827, to permit exhaust or intake of air from or to locker 800 along any door or wall. Alternatively, the natural gaps left between doors and openings in locker 800 can provide the exhaust or intake of air. Lower ventilation 855 and upper ventilation 857 and any attached dampers may be controlled (opened or closed, fully or partially) manually or automatically, as by a programmed computer. Automatically controlled grilles may operate on a "schedule" (e.g. open or closed at night or during daylight hours) or according to airflow or other parameters, such as relative humidity in the locker room and the like.

Thus, airflow may be established through locker 800 from plenum 303, through lower ventilation 855 and upper ventilation 857, and out of locker 800 through other grilles or other openings in the front or forward-facing portions of locker 800. Alternatively, air circulated through locker 800 may be exhausted through a duct or conduit to an area remote from locker 800 and/or the locker room or building in which the lockers 800 are located. Ventilation may be assisted by one or more circulation fans located in locker 800 (not shown). Some embodiments of locker 800 may include components to enable ventilation in seat assembly 832.

To the right side of the interior area, locker 800 preferably contains upper shoe storage compartment 813 and lower shoe storage compartment 825. Both upper shoe-storage compartment 813 and lower shoe storage compartment 825 include a pair of spaced-apart, opposed or opposing front and rear end walls 803, which are connected at the top and bottom. Lower heavy duty self-closing rail 863 and upper heavy duty self-closing rail 865 may be mounted at the top and bottom of end walls 803 and are secured to the interior of sidewalls 801 on upper shoe storage compartment 813 and lower shoe storage compartment 825 to permit upper shoe storage compartment 813 and lower shoe storage compartment 825 to slide or move between extended and retracted positions. Lower heavy duty self-closing rail 863 and upper heavy duty self-closing rail 865 may be located elsewhere along the vertical dimension of shoe storage compartment 813 and lower shoe storage compartment 825 as well. Upper shoe storage compartment 813 and lower shoe storage compartment 825 may vary in height, width, and depth but should be large enough in all dimensions to accommodate at least one pair of shoes and preferably two or more pairs. Upper shoe storage compartment 813 and lower shoe storage compartment 825 may be provided with illumination in the form of LED lights or other illumination sources. Such illumination may be controlled by switches that turn the illumination on or off as shoe storage compartment 813 and lower shoe storage compartment 825 are opened and closed.

Figure 16:
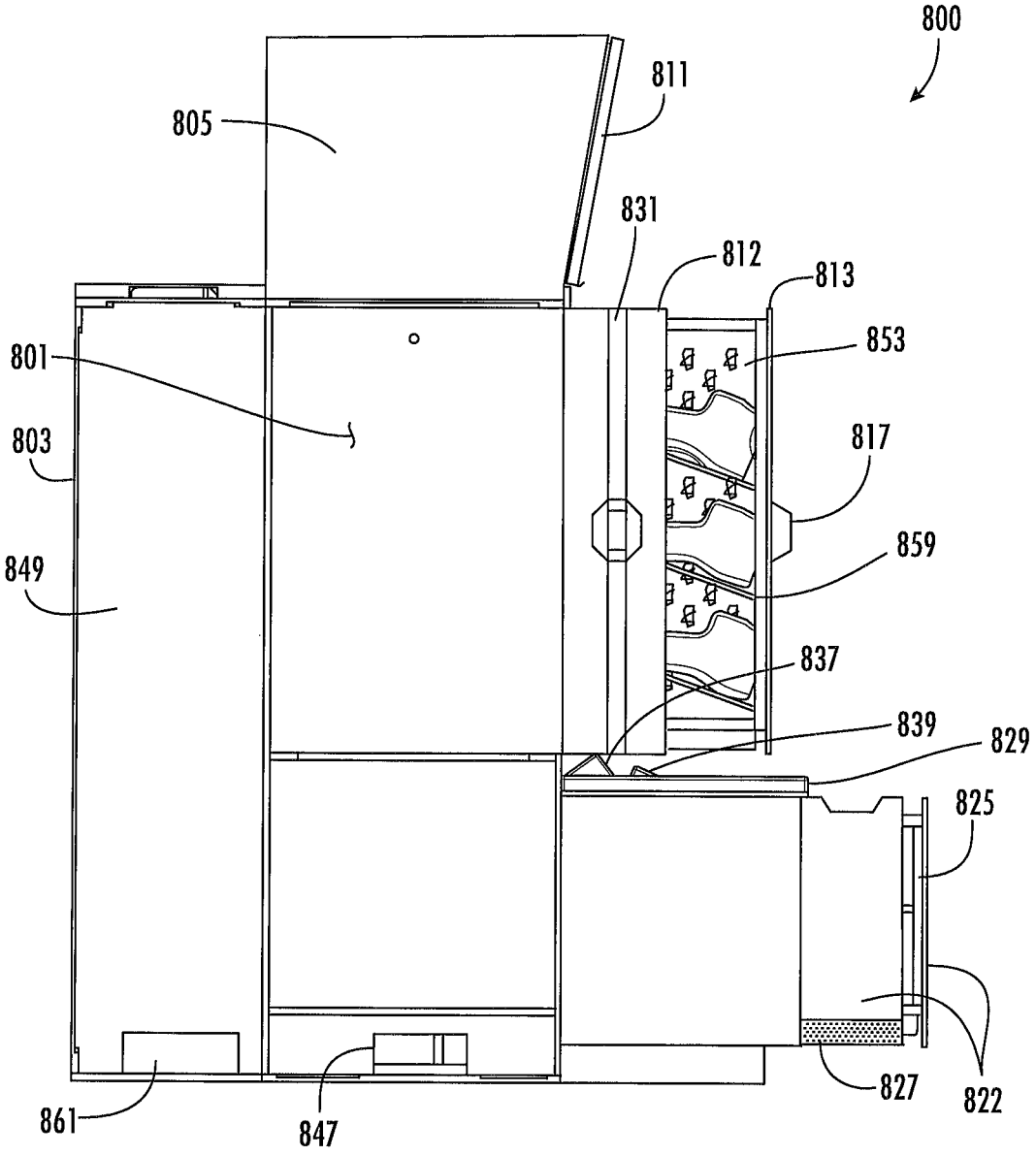
FIG. 16 is a left-side view of the alternative locker of FIG. 12, where all of the side compartment doors have been opened.
Figure 17:
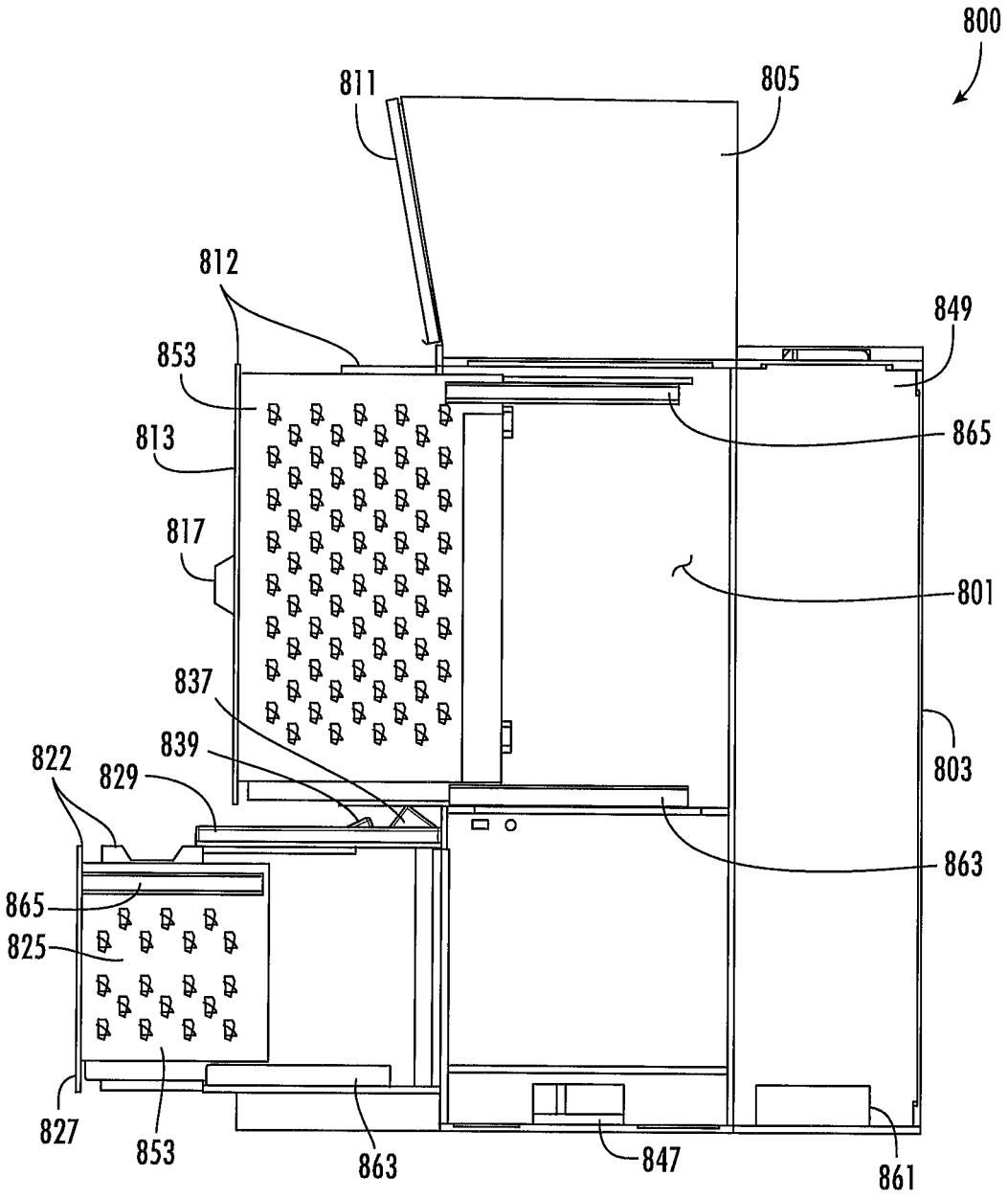
FIG. 17 is a right-side view of the alternative locker of FIG. 12, where all of the side compartment doors have been opened.

As shown in FIG. 16, a plurality of pairs of generally opposed or opposing projections 859 are secured to the end walls 803 within shoe storage compartment 813 and lower shoe storage compartment 825 in a slightly staggered fashion. Projections 859 serve to temporarily secure and support shoes in a storage position within shoe storage compartment 813 and lower shoe storage compartment 825. In the preferred embodiment according to the present application, projections 859 are designed to support shoes from underneath, but in other embodiments may support footwear by fitting inside the footwear and holding footwear either upright or upside down. Projections 859 preferably are formed of sheet stainless steel, bent at an angle, with a vertical portion riveted, screwed, or otherwise fastened to end walls 803 within shoe storage compartment 813 and lower shoe storage compartment 825. Projections 859 may be shorter or longer than illustrated to accommodate different sizes or types of shoes (e.g. provided with notches for "flip flops," or shaped differently to accommodate boots or other high-topped shoes) and to accommodate gloves (with or without individual finger projections). Projections 859 may be provided with electric resistance or other heating elements to assist drying of shoes or other equipment. Projections 859 may be provided with anti-odor, anti-fungal, or anti-bacterial coatings or inserts to prevent odor or infections. Projections 859 may also be adjustable as to length or angle via hinges and other mechanisms so that projections 859 can be customized to accommodate different types of shoes, gloves, and other equipment. Projections 859 may also be hollow and connected to a forced-air ventilation system to provide additional air circulation within and about any footwear or equipment contained in upper shoe storage compartment 813 and lower shoe storage compartment 825.

At least one side of upper shoe storage compartment 813 and lower shoe storage compartment 825 must be open-faced when upper shoe storage compartment 813 and lower shoe storage compartment 825 are extended from locker 800 to permit access to projections 859. A ventilated shoe storage wall 853 extends between end walls 803 in upper shoe storage compartment 813 and lower shoe storage compartment 825 to add strength to the enclosure while also facilitating air flow through upper shoe storage compartment 813 and lower shoe storage compartment 825. The perforations in ventilated shoe storage wall 853 permit air circulation to help stored shoes dry. Air may be supplied to upper shoe storage compartment 813 and lower shoe storage compartment 825 by a forced-air ventilation system (either wholly or partially self-contained or coupled to building HVAC). Such ventilation may include anti-odor, anti-fungal, or anti-bacterial treatments. A removable debris tray, while not shown, may be disposed at the bottom of upper shoe storage compartment 813 and lower shoe storage compartment 825 to catch mud, grass, and other debris from shoes stored in shoe storage compartment 813 and lower shoe storage compartment 825. The tray may be removed, and debris emptied and replaced.

In operation, the user pulls upper shoe storage compartment 813 and lower shoe storage compartment 825 from the retracted position into the extended position by using handle 817 for upper shoe storage compartment 813 or lower compartment door handle 824 for lower shoe storage compartment 825. The user then places recently worn, dirty, and sweaty or otherwise wet shoes onto projections 859. Upper shoe storage compartment 813 and lower shoe storage compartment 825 then may be closed, and any shoes or equipment contained within upper shoe storage compartment 813 and lower shoe storage compartment 825 will dry. Any dried mud or grass or other debris falling from shoes may land on the tray, which may be removed for disposal of the debris. Components of upper shoe storage compartment 813 and lower shoe storage compartment 825 may be made of various materials such as metal, wood, laminate, composite, or polymer, depending on the designs of locker 800. In the preferred embodiment according to the present application, upper shoe storage compartment 813 and lower shoe storage compartment's 825 components are primarily made of stainless steel.

Figure 18:
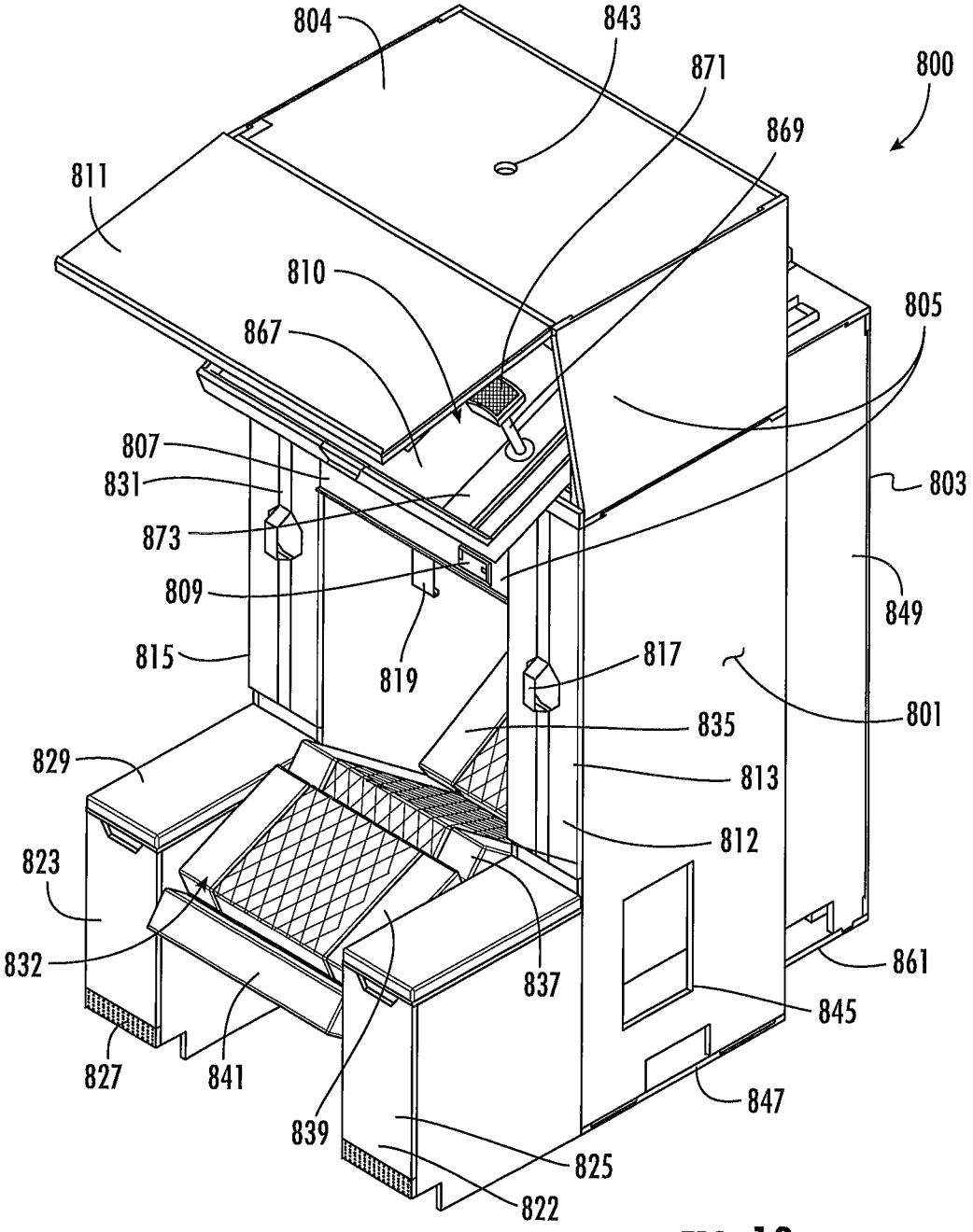
FIG. 18 is a perspective view of the alternative locker of FIG. 12, where the top compartment door has been opened.
Figure 19:
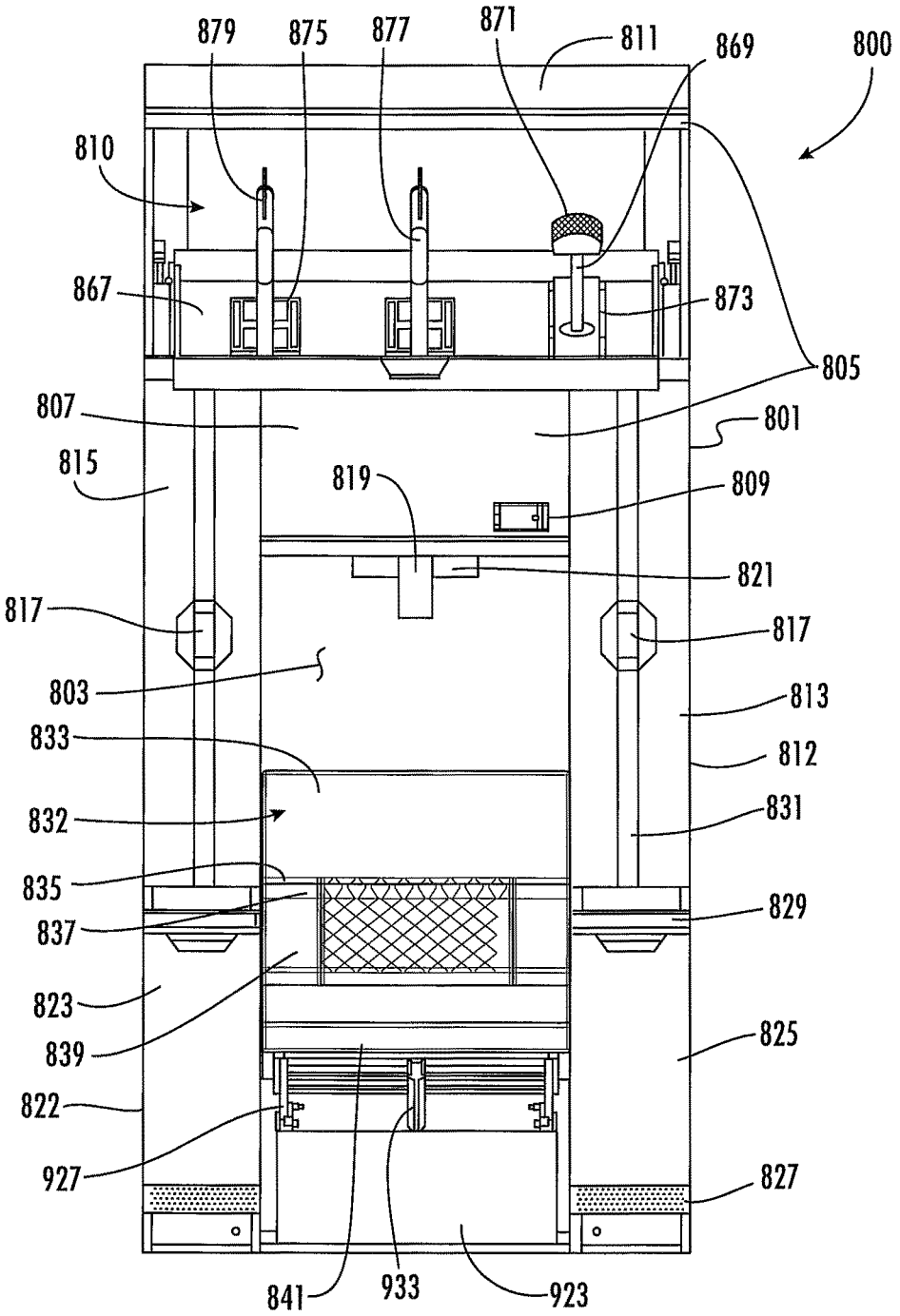
FIG. 19 is a front view of the alternative locker of FIG. 12, where the top compartment door has been opened.
Figure 20:
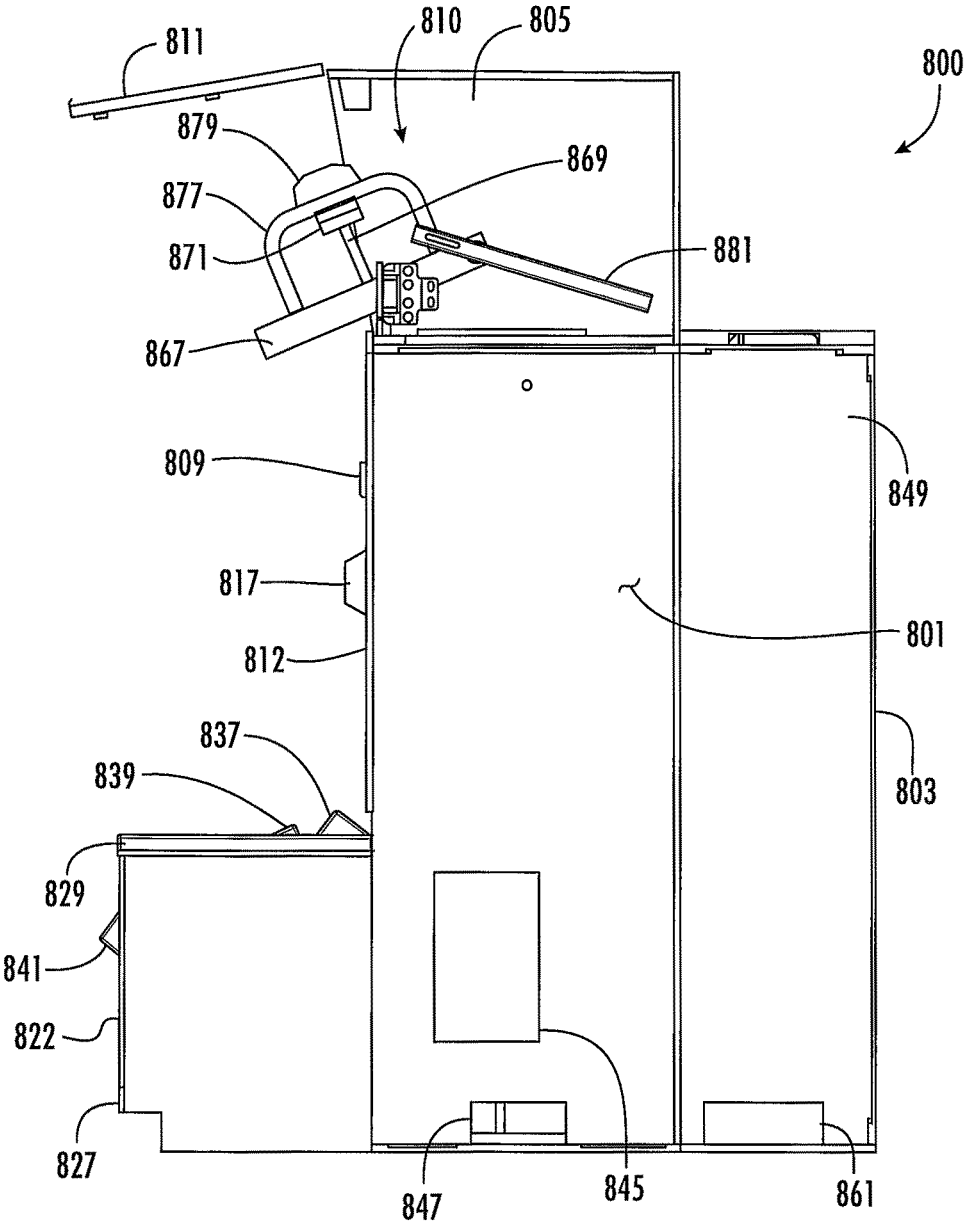
FIG. 20 is a right-side view of the alternative locker of FIG. 12, where the top compartment door has been opened.

Referring now also to FIGS. 18-20 in the drawings, locker 800 according to the alternative embodiment from FIG. 12 is depicted with upper compartment door 811 opened. FIGS. 18-20 show that locker 800 further comprises upper compartment 810, tray 867, helmet post 869, helmet support member 871, helmet post support 873, ventilated equipment rack support 875, ventilated equipment rack 877, equipment rack fin 879, and roller assembly 881. Compartment 810 is behind upper compartment door 811 and provides a location where individuals can store helmets or other equipment to dry when not being used. Located above compartment 810 is top hole 843 which provides a location for a circular light puck to be inserted into locker 800. The circular light puck inserted into top hole 843 will provide light for compartment 810 and may be activated remotely by an individual or the light puck may be activated when an individual opens upper compartment door 811.

Provided within compartment 810 is tilting and sliding tray 867. Tray 867 may slide forward and tilt or rotate downward to improve access to equipment stored on helmet post 869 and vented equipment rack 877, as depicted in FIG. 19. This motion is enabled by a pair of roller assemblies 881 shown in FIG. 20. Roller assemblies 881 may be mounted on the sidewalls of the upper compartment 810. Tray 867 may be mounted to roller assemblies 881 which allows tray to tilt and slide out of compartment 810.

Located on top of sliding tray 867 are helmet support member 871 and ventilated equipment rack 877. Helmet support member 871 is suspended above tray 867 by helmet post 869 which is connected to tray 867 by helmet post support 873. Helmet support member 871 has a ventilated top which allows airflow supplied through helmet post 869 and post support 873 to flow into the equipment stored on member 871. Helmet support member 871 may further incorporate a ventilator or helmet ventilation system. The ventilator may be an electric fan or may be a vented opening connected to the HVAC system of locker 800. The fan or HVAC system may circulate air in, around, and through a helmet or other equipment stored on support member 871 for drying and deodorization purposes. The ventilation of helmet support member 871 may be controlled by a switch which may be actuated by the weight of a helmet on the helmet support member 871, or the ventilation may be controlled manually, by a timer, by voice actuation, by detection of the presence of a condition such as heat, moisture, or odor, or the like. Helmet support member 871 and helmet post 869 may be constructed of steel or aluminum tubing, welded, or otherwise secured together. The hollow nature of the preferred tubing may permit passage of electric cables and air or other gases for power or ventilation.

Also located on top of sliding tray 867 are two ventilated equipment racks 877. Ventilated equipment rack 877 is similar in operation to helmet support member 871 but is used for larger pieces of equipment. Ventilated equipment rack 877 is intended for storage of pads, e.g. shoulder pads, only, and no helmet. Accordingly, equipment rack fin 879, located on top of equipment rack 877, serves to help "center" or locate pads on rack 877. Ventilated equipment rack 877 is connected to tray 867 with ventilated equipment rack support 875 that has two fans in the center to force air into the equipment stored on rack 877. Like helmet support member 871, ventilated equipment rack 877 may incorporate a ventilator or helmet ventilation system as described above. While two ventilated equipment racks 877 are shown in the present application, an alternative embodiment may exist where only one ventilated equipment rack 877 is present in locker 800 or where more than two ventilated equipment racks 877 are used.

Figure 21B:
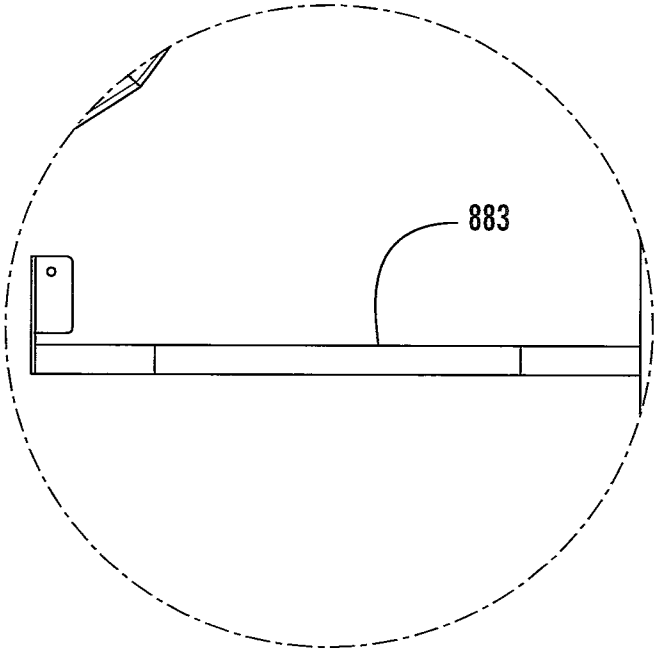
FIG. 21B is scaled up view of detail A of the locker from FIG. 21A.
Figure 21A:
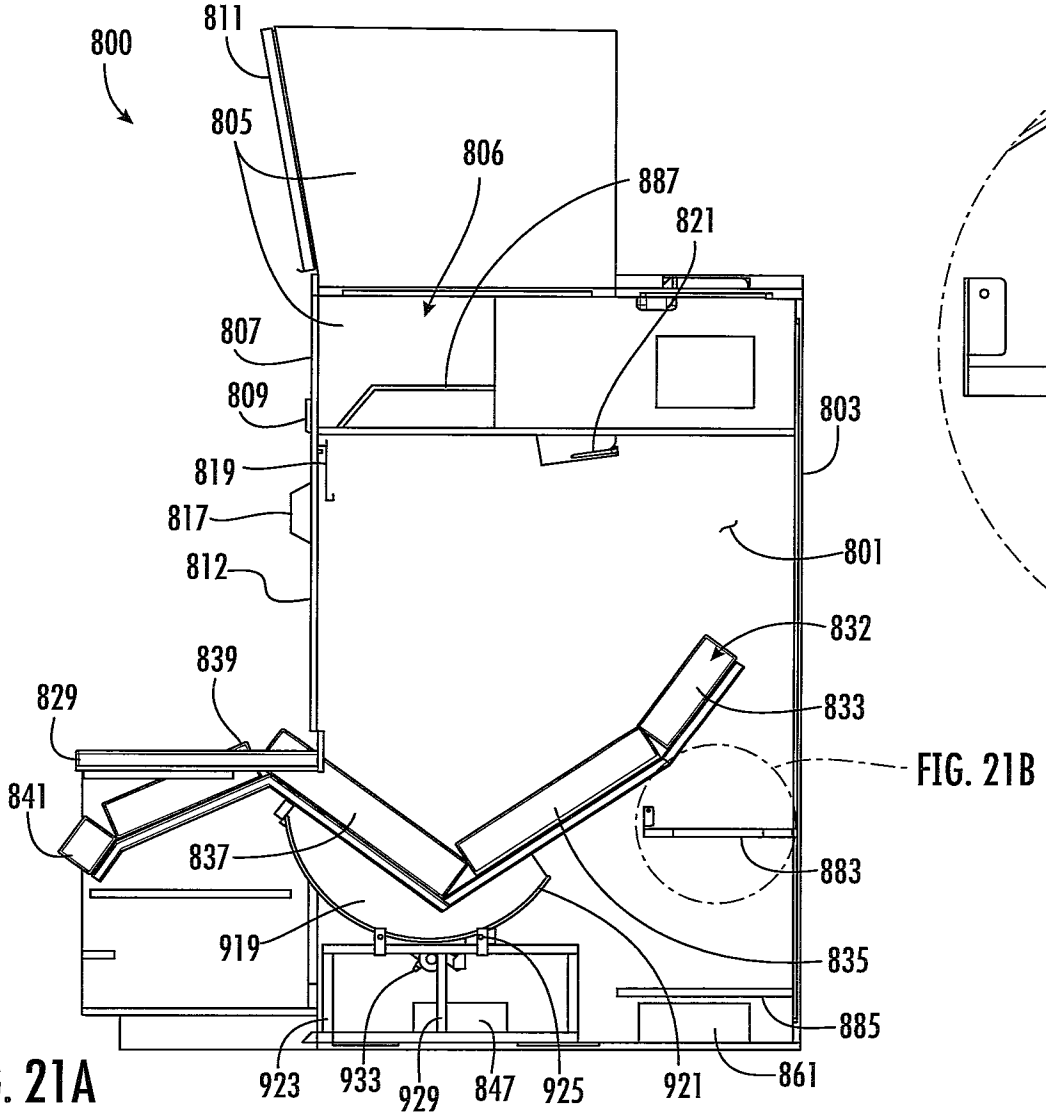
FIG. 21A is a right-side cross section view of the alternative locker of FIG. 12; where detail A of the locker has been circled for a scaled up drawing.

Referring now also to FIGS. 21A and 21B in the drawings, a cross-section side view of locker 800, according to the alternative embodiment from FIG. 12, is depicted. FIG. 21A shows that locker 800 is further comprised of lower compartment 806, back tray 883, locker lift support bar 885, lower compartment storage tray 887, curved base 919, curved base grooves 921, seat support base 923, seat support fasteners 925, linear actuator support wall 929, and linear actuator 933. FIG. 21B is a scaled-up view of back tray 883 seen in FIG. 21A. This view in FIG. 21B is taken from the circled section A found in FIG. 21A.

Lower compartment 806 is stored behind lower compartment door 807 and contains storage tray 887. Storage tray 887 provides a location where users can store personal items within locker 800. Storage tray 887 may either be stationary within lower compartment 806 or may be movable such as with sliding tray 867 found within upper compartment 810. It is also appreciated that a charging station may be disposed within storage tray 887 to allow individuals to charge electronic devices while stored inside lower compartment 806.

Back tray 883 is located at the back of back wall extension 849 and is a flat surface stretching behind seat assembly 832. Back tray 883 will catch anything that a user seated in seat assembly 832 would drop while in the reclined position. If back tray 883 was not located in this position, items that a user would drop would get stuck behind seat assembly 832 and the user would need to remove seat assembly 832 from locker 800 to retrieve the dropped item. Back tray 883 provides an easy to reach location to recover dropped items without having to remove seat assembly 832. Also located behind seat assembly 832 within locker 800 is locker lift support bar 885 which supports locker 800 when an individual is moving locker 800. At the lower bottom of back wall extension 849 are openings (not shown) that open into the back of wall extension 849. Locker lift support bar 885 is located above these openings in wall extension 849 which provides an upper surface where pressure can be applied to lift locker 800 off the ground. Locker lift support bar 885 works with forklifts or other lifting devices to help individuals move locker 800 without having to lift locker 800 from the bottom. When a lifting device is inserted into the back openings and placed under support bar 885, pressure will be applied to the lifting device from the top by support bar 885 and at the bottom by locker 800 which increases the stability of the system while in movement.

Figure 22B:
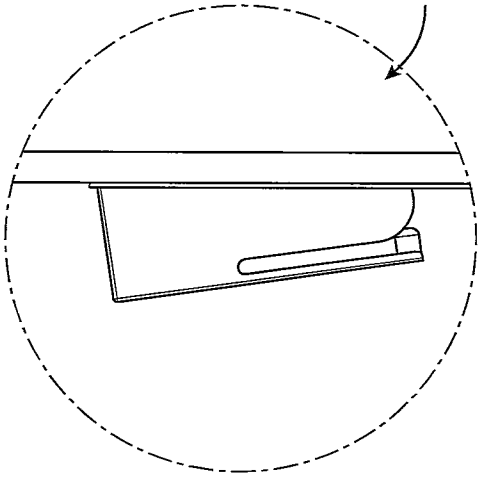
FIG. 22B is scaled up view of detail B of the locker from FIG. 22A.
Figure 22A:
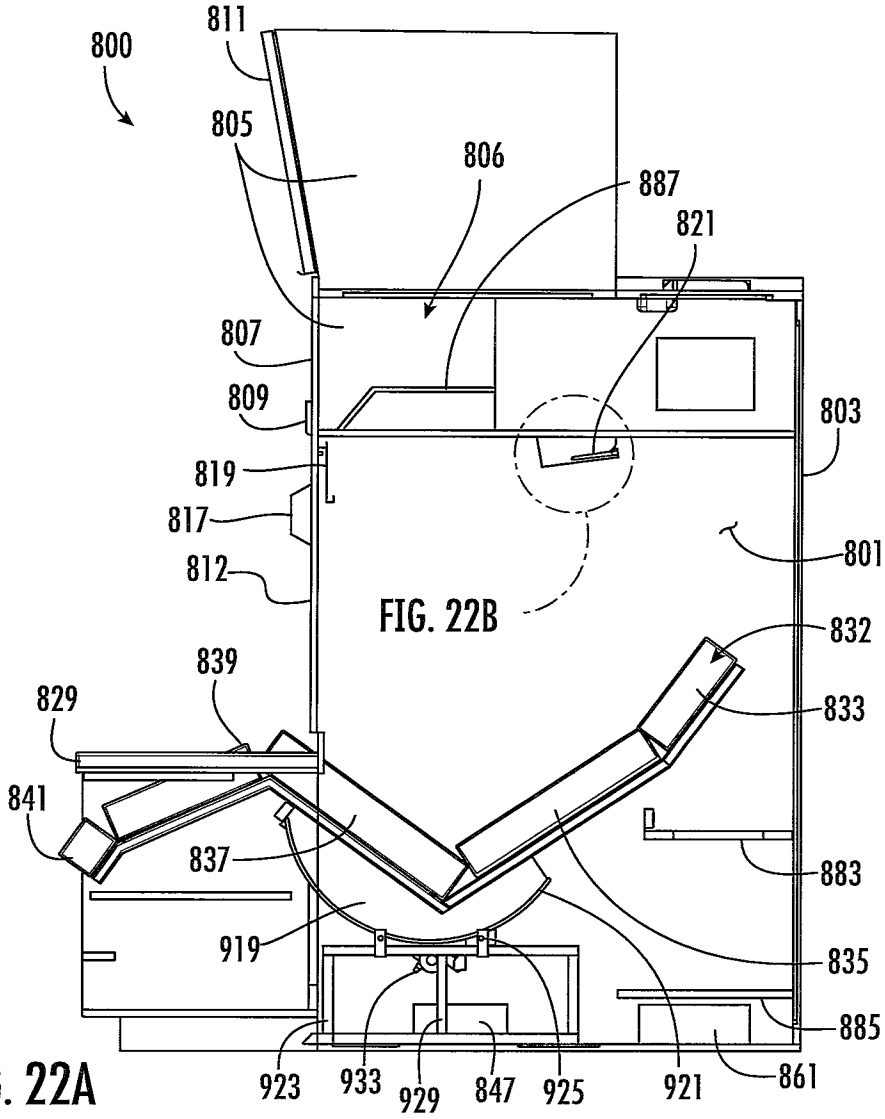
FIG. 22A is a right-side cross section view of the alternative locker of FIG. 12; where detail B of the locker has been circled for a scaled up drawing.
Figure 23:
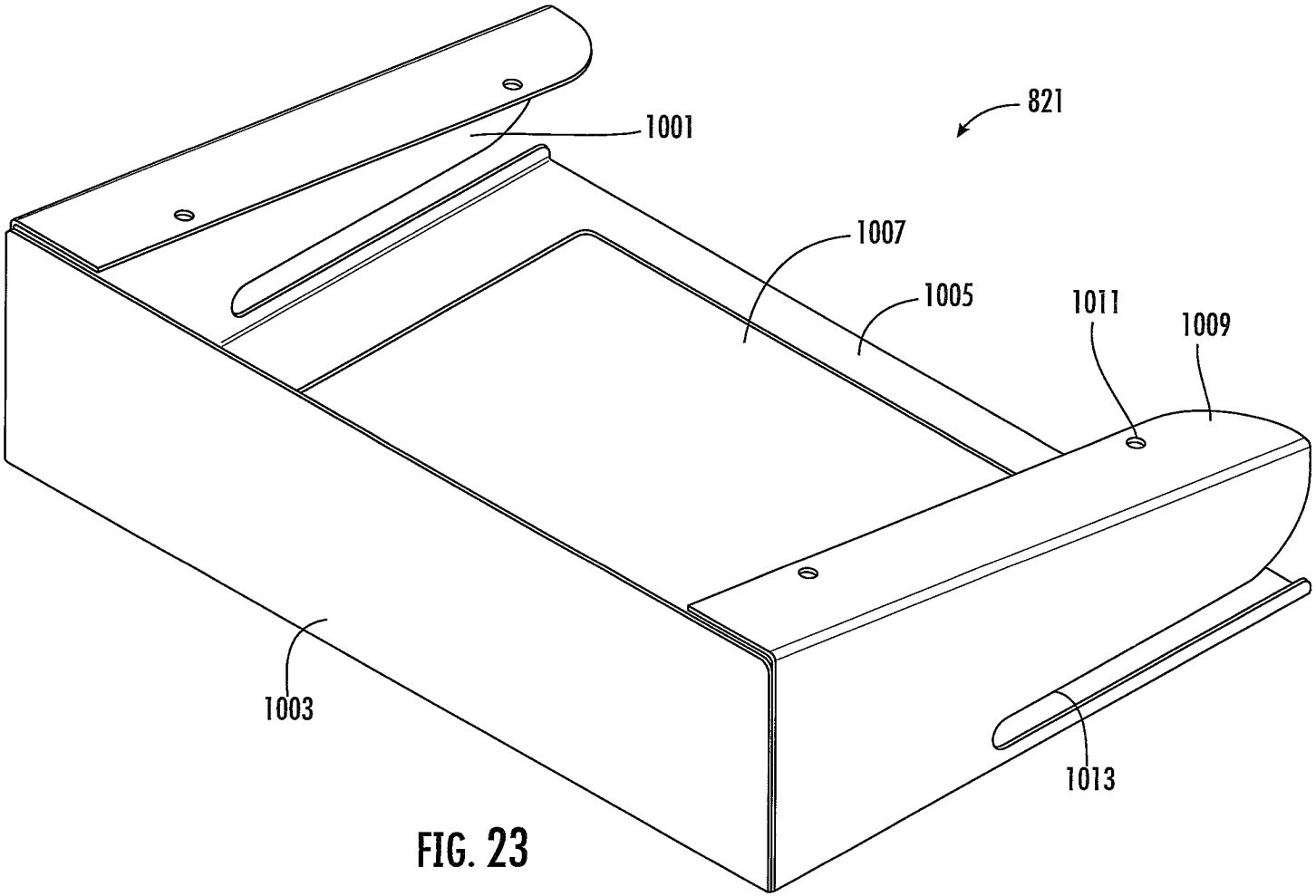
FIG. 23 is a perspective view of the electronic device holder according to the alternative embodiment of FIG. 12.

Referring now also to FIGS. 22A and 22B in the drawings, a cross-section side view of locker 800, such as the view in FIGS. 21A and 21B, are depicted. Referring also to FIG. 23, a close-up perspective view of electronic device holder 821 from FIGS. 22A and 22B is depicted. FIG. 23 provides a closer view of electronic device holder 821 showing that electronic device holder is comprised of side walls 1001, back wall 1003, bottom support wall 1005, bottom wall opening 1007, top wall connectors 1009, fastening points 1011, and side walls opening 113. Device holder 821 is made of the same material as locker 800 and is positioned at the top of the inside of locker 800.

Device holder 821 has two side walls 1001 where one width end is larger than the other with the smaller width end being the opening for electronic devices to be inserted into device holder 821. This difference in widths between the two sides of sidewalls 1001 creates a sloped ramp for device holder 821 such that the electronic device placed inside holder 821 will be angled for optimum viewing when an individual is reclined in seat assembly 832. At the smaller width end of side walls 1001 there are side wall openings 1013 which are grooves at the bottom of side walls 1001 that run the majority of the length of side walls 1001. Side wall openings 1013 allow an individual using device holder 821 to insert a device through openings 1013 which will then hold the device within device holder 821. The ends of side walls 1001 that have the larger width are connected together by back wall 1003. Back wall 1003 will also function as a stop for device holder 821 for any smaller devices placed inside which would not be support by side wall openings 1013.

Side walls 1001 are connected at the bottom by a bottom wall 1005 which spans the full distance between side walls 1001. Bottom wall 1005 also has bottom wall opening 1007 which is a section of material cut away so that an individual will still be able to touch and use the electronic device when in holder 821. An alternative embodiment may also exist where instead of having bottom wall opening 1007 electronic device holder 821 will have a thin sheet of material spanning the distance of bottom wall opening 1007 that will be thick enough to support an electronic device while also being thin enough where an individual will still be able to touch and use electronic device when placed in holder 821. Connecting the top portions of side walls 1001 and back wall 1003 are top wall connectors 1009 which are flat and protrude out slightly beyond side walls 1001. Top wall connectors 1009 further have fastening points 1011 which are openings in top wall connectors 1009 where an individual will be able to insert a fastener to secure top wall connectors 1009 to locker 800. Once secured to locker 800, top wall connectors 1009 will support the entirety of electronic device holder 821 while in use.

Figure 24B:
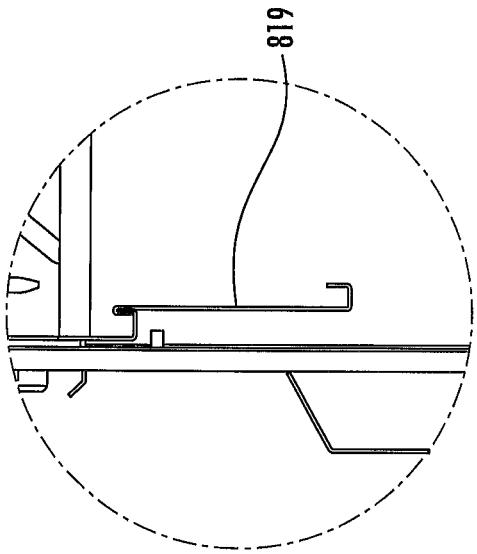
FIG. 24B is scaled up view of detail C of the locker from FIG. 24A.
Figure 24A:
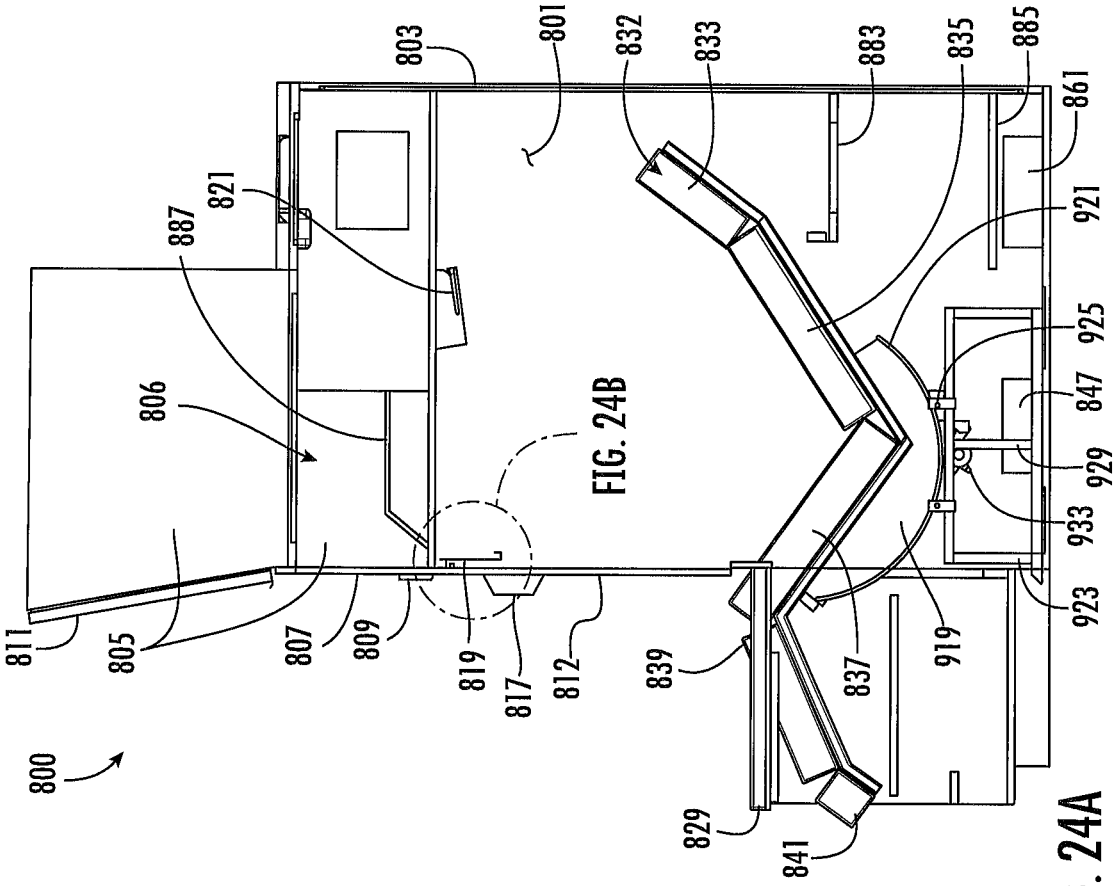
FIG. 24A is a right-side cross section view of the alternative locker of FIG. 12; where detail C of the locker has been circled for a scaled up drawing.

Referring now also to 24A and 24B in the drawings, cross-section side views of locker 800, an alternative embodiment of the present application from FIG. 12, are depicted. FIG. 24B is also a scaled-up drawing of game day hook 819 found in FIG. 24A. Like in FIGS. 21A and 21B, FIGS. 24A-24B provide the same view of the side of locker 800 while providing closer views of inner features of locker 800 that were not closely seen in previous drawings.

Figure 25:
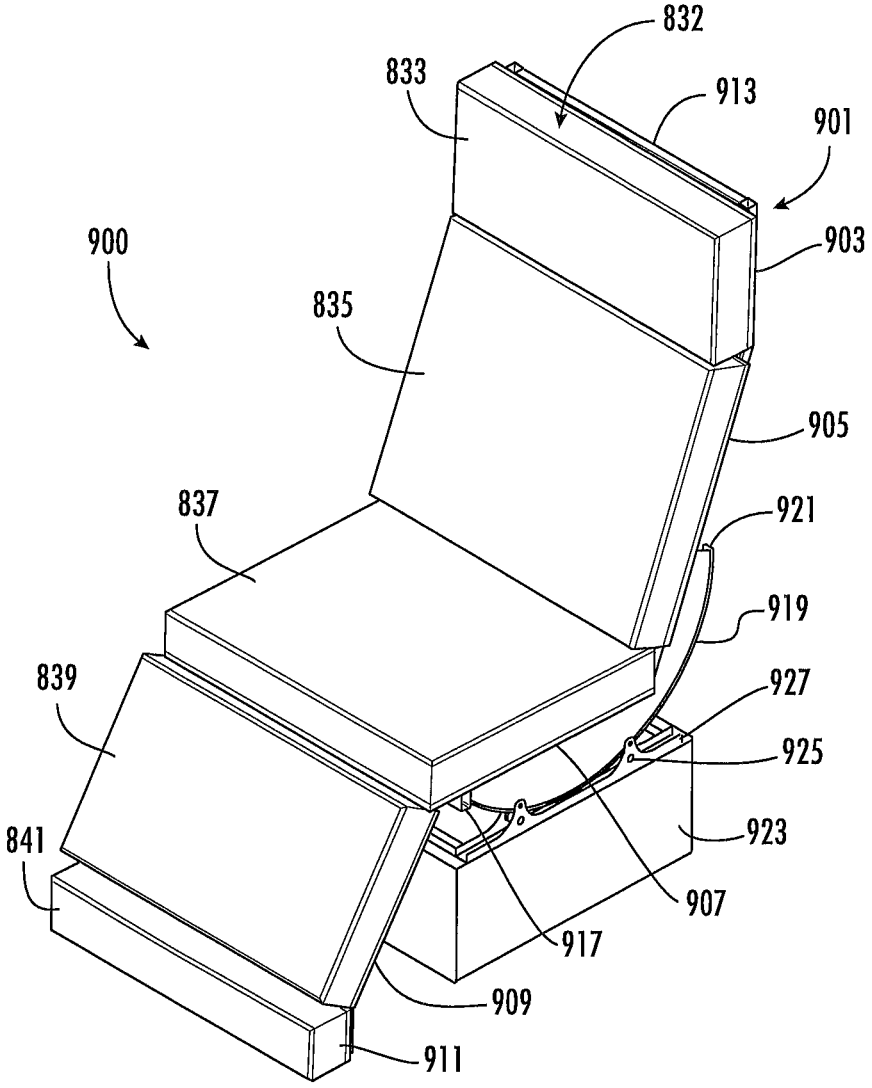
FIG. 25 is a perspective view of the reclining seat according to the alternative embodiment of FIG. 12.
Figure 26:
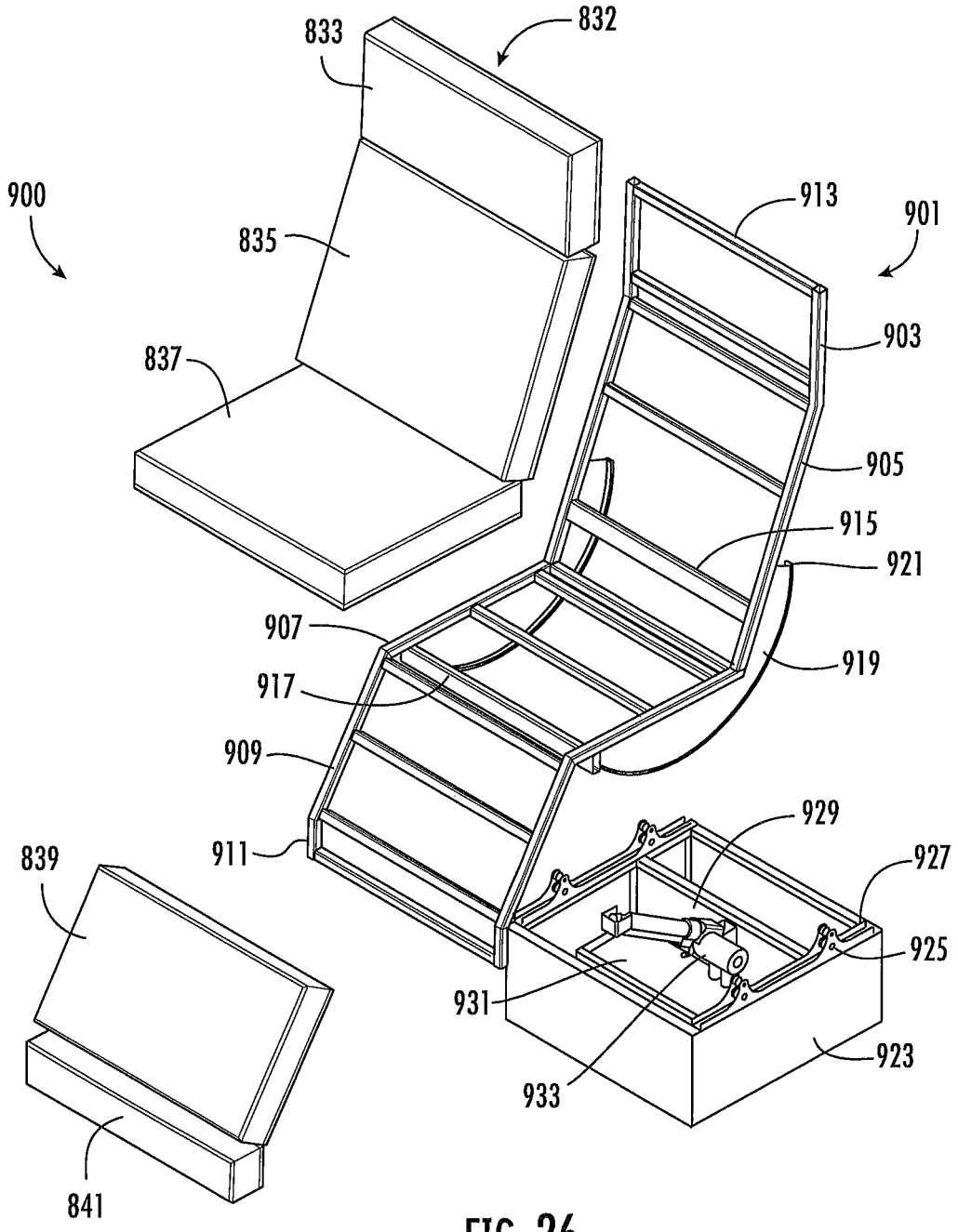
FIG. 26 is an exploded perspective view of the reclining seat according to an alternative embodiment of FIG. 12.
Figure 27:
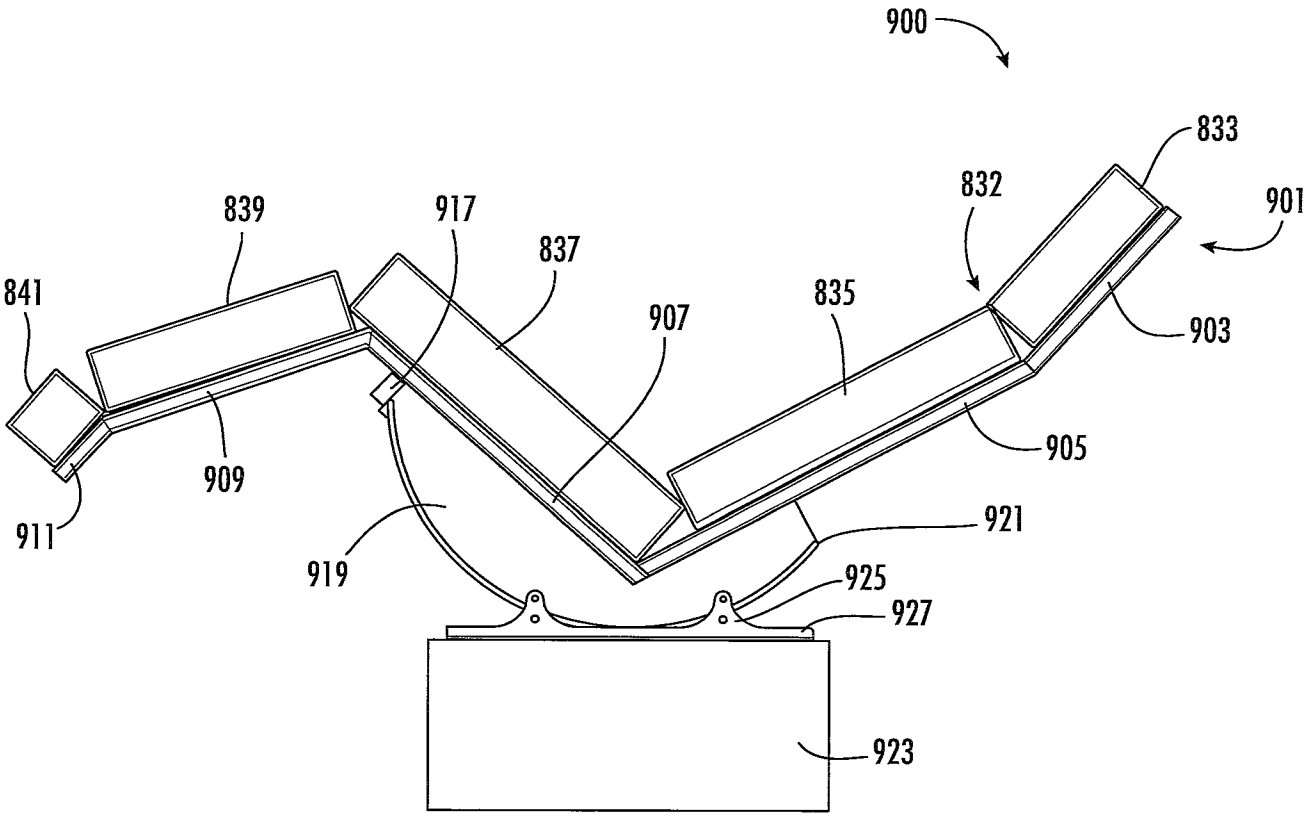
FIG. 27 is a right-side view of the reclining seat according to an alternative embodiment of FIG. 12.

Referring now also to FIGS. 25-27 in the drawings, seat assembly 832 and seat support assembly 900 found in locker 800 are depicted. As described above, seat assembly 832 is comprised of seat head rest 833, seat back 835, seat cushion 837, a leg rest 839, and a footrest 841. As further shown in these figures, seat support assembly 900 is comprised of frame assembly 901, headrest support bars 903, side support bars 905, seat support bars 907, leg rest support bars 909, footrest support bars 911, connecting support bars 913, seat back support bar 915, linear actuator support bar 917, curved base 919, curved base grooves 921, seat support base 923, seat support fasteners 925, seat support grooves 927, linear actuator support wall 929, linear actuator support base 931, and linear actuator 933. While not shown in these figures, sections of seat assembly 832 may be customized to include emblems of the team or logos of the team whose locker room locker 800 is placed in.

FIG. 26 shows an exploded view of seat assembly 832 in relation to seat support assembly 900 and where sections of seat assembly 832 will connect to frame assembly 901. Frame assembly 901 is a series of support bars providing a location where the different cushions of seat assembly will be attached. The section of frame assembly 901 that connects to seat assembly 832 is broken into five sections corresponding to the five seat cushions that make seat assembly 832. The first section, where seat head rest 833 is connected, consists of the two parallel head rest support bars 903. The second section, where seat back 835 is connected, consists of two parallel side support bars 905 connected to the bottom of head rest support bars 903 at a slight angle. The third section, where seat cushion 837 will attach, consists of two parallel seat support bars 907 connected at the bottom of side support bars 905 at an angle where seat support bars 907 will be parallel with the ground when seat assembly 832 is in the upright position. The fourth section, where leg rest 839 connects, is comprised of two parallel leg rest support bars 909 which are connected at an angle to the bottom of seat support bars 907. The final section, where footrest 841 is connected, is comprised of two parallel footrest support bars 911 connected at an angle to the bottom of leg rest support bars 909. Running across the parallel bars of each section are connecting support bars 913 which connect perpendicularly to the sides of the parallel support bars running the length between them providing another place to secure seat assembly 832. The support bars described above may be connected to each other either by welding or fasteners. The support bars are also hollow to decrease the weight of seat support assembly 900 to make it easier for an individual to move support assembly 900 into and out of locker 800.

Attached perpendicularly to and running the length between side support bars 905 is seat back support bar 915. Back support bar 915 is thicker than connecting support bars 913 and is used as an extra support connecting to seat back 835. Seat support assembly 900 further has linear actuator support bar 917 running perpendicular to and connecting to seat support bars 907. Actuator support bar 917 is connected to the bottom of seat support bars 907 and as such, actuator support bar 917 hangs below seat support bars 907. Actuator support bar 917 is thicker than connecting support bars 913 and connects to linear actuator 933 which is used to move seat assembly 832. Alternative embodiments may also exist where support assembly 900 may contain more than one actuator support bar 917 and more than one linear actuator 933 which can be used to facilitate a smoother movement of seat assembly 832 or to allow each cushion of seat assembly 832 to move independently. Frame 901 further has curved base 919 attached on each side of frame 901 and connects to both side support bars 905 and seat support bars 907. Curved base 919 also has curved base grooves 921 running the length of the curved edge. Curved base grooves 921 are used to connect frame assembly 901 to seat support base 923 while also helping facilitate the movement of seat assembly 832 from the upright position to the reclined position.

FIG. 25 further highlights the structure of seat support base 923 and how base 923 connects to the rest of seat support assembly 900. Support base 923 is a hollow cube made of sheet metal where the top face of the cube is not included which provides an opening into support base 923. The extra surface area provided by the sheet metal of support base 923 increases the structural integrity of the seat support assembly 900 to better lift and support seat assembly 832. When seat support assembly 900 has been moved into place within locker 800, support base 923 may either be secured in place within locker 800 by fasteners or support assembly 900 may be secured in place by the weight of support assembly 900 and seat assembly 832.

Attached to the top sides of support base 923 are two seat support grooves 927 where curved base 919 will be inserted into. Seat support grooves 927 provide a fixed rail for curved base 919 so that curved base 919 will tilt within grooves 927 to facilitate movement of seat assembly 832. Seat support grooves 927 further has seat support fasteners 925 at the center which connect with curved base grooves 921 to secure frame assembly 901 to support base 923. Fasteners 925 and seat support grooves 927 will provide a range of motion for curved base 919 to travel in order to move seat assembly 832 from the reclined position to the upright position.

Between the side walls of support base 923, there is linear actuator support wall 929 running the distance between the side walls along with linear actuator support base 931 connecting to the bottom of the side walls and support wall 929. When linear actuator 933 is in use, actuator 933 will apply downward pressure against base 931 when actuator is lifting seat assembly 823. Linear actuator 933 also applies pressure against support wall 929 when actuator 933 is tilting seat assembly 823 into the reclined position. Support wall 929 and support base 931 distribute the pressure applied by actuator 933 to the rest of the sheet metal faces of support base 923 which decreases the amount of stress applied at any one point. Distributing the stress in this manner decreases the chance that something will break under the force of the pressure which increases the lifespan of the system.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered, modified and/or combined, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. A locker, comprising:

a main storage area defined by a pair of upstanding side walls and a back wall;

a reclining seat disposed at least partially between the pair of upstanding side walls, the reclining seat being movable between an upright and a reclined position;

a plurality of compartments defined between the pair of upstanding sidewalls, including at least one side compartment and at least one center compartment;

an electronic device holder disposed between the pair of upstanding side walls for suspending a personal electronic device, the electronic device holder comprising:

a device storage area defined by at least one pair of side walls, a back wall, and a bottom support wall;

an opening disposed through the bottom support wall, the opening being configured to allow the individual to use the personal electronic device when positioned within the device storage area; and at least one top wall connector; and a seat support assembly, the seat support assembly comprising:

a frame assembly;

at least one curved base;

a seat support base; and a linear actuator extending outwardly from the seat support base to the reclining seat, the linear actuator being configured to tilt the reclining seat between the upright and the reclined position.

2. The locker according to claim 1, wherein the reclining seat comprises:

a headrest;

a seatback;

a bench;

a leg rest; and a footrest.

3. The locker according to claim 1, wherein the electronic device holder further comprises:

at least one opening extending at least partially along a length of at least one pair of side walls, the at least one opening being configured to securely receive the personal electronic device.

4. The locker according to claim 1, wherein the electronic device holder further comprises:

a thin sheet of material covering the opening in the bottom support wall.

5. The locker according to claim 1, wherein the frame assembly of the seat support assembly comprises:

at least one pair of headrest support bars;

at least one pair of side support bars;

at least one pair of seat support bars;

at least one pair of leg rest support bars;

at least one pair of footrest support bars; and a plurality of connecting support bars extending across the frame assembly.

6. The locker according to claim 1, wherein the frame assembly of the seat support assembly further comprises:

at least one seat back support bar configured to receive the reclining seat; and at least one linear actuator support bar configured to receive the linear actuator.

7. The locker according to claim 1, wherein the seat support assembly further comprises:

a curved base groove extending along a curved length of the at least one curved base.

8. The locker according to claim 7, wherein the seat support base of the seat support assembly further comprises:

at least one seat support groove sized to receive the at least one curved base; and at least one seat support fastener disposed within the at least one seat support groove, the at least one seat support fastener being configured to slot within the curved base groove and secure the at least one curved base within the at least one seat support groove.

9. The locker according to claim 1, wherein the seat support base comprises:

at least one pair of opposing side faces; and a bottom face connecting the at least one pair of opposing side faces.

10. The locker according to claim 9, wherein the pair of opposing side faces and the bottom face of the seat support base are made of sheet metal.

11. The locker according to claim 1, wherein the seat support base of the seat support assembly further comprises:

a linear actuator support wall; and a linear actuator support base.

* * * * *